US007634924B2

(12) United States Patent
Chuang et al.

(10) Patent No.: US 7,634,924 B2
(45) **Date of Patent: *Dec. 22, 2009**

(54) KNIT BY DESIGN METHOD AND FABRIC

(75) Inventors: Cheng-Yuan Chuang, Panchiao (TW); Graham H. Laycock, Grangeford (SG); Raymond S. P. Leung, Shatin (HK); Elizabeth Todd Singewald, Wilmington, DE (US); Peter George Szanto, Lincoln University, PA (US); Fred Wynegar, Wilmington, DE (US)

(73) Assignee: Invista North America S.ár.l., Wilmington, DE (US)

( * ) Notice: Subject to any disclaimer, the term of this patent is extended or adjusted under 35 U.S.C. 154(b) by 854 days.

This patent is subject to a terminal disclaimer.

(21) Appl. No.: 11/203,078

(22) Filed: Aug. 12, 2005

(65) Prior Publication Data

US 2006/0010929 A1 Jan. 19, 2006

Related U.S. Application Data

(63) Continuation-in-part of application No. PCT/US2004/017364, filed on Jun. 1, 2004, and a continuation-in-part of application No. 11/018,003, filed on Dec. 21, 2004.

(51) Int. Cl.
*D04B 1/18* (2006.01)

(52) U.S. Cl. ..... 66/198; 66/8

(58) Field of Classification Search ..... 66/196–202, 66/8; 442/304, 306, 313
See application file for complete search history.

(56) References Cited

U.S. PATENT DOCUMENTS

| | | | | |
|---|---|---|---|---|
| 3,392,552 | A | 7/1968 | Muller et al. | |
| 4,875,241 | A | 10/1989 | Browder et al. | |
| 5,198,288 | A | 3/1993 | Grunfeld | |
| 5,584,196 | A | 12/1996 | Taylor et al. | |
| 5,687,587 | A | 11/1997 | Michel | |
| 5,931,023 | A | 8/1999 | Brach et al. | |
| 5,948,875 | A | 9/1999 | Liu et al. | |
| 6,263,797 | B1 | 7/2001 | Brice | |
| 6,458,166 | B1 | 10/2002 | Fleissner | |
| 6,472,494 | B2 | 10/2002 | Houser et al. | |
| 6,776,014 | B1 | 8/2004 | Laycock et al. | |
| 6,846,866 | B2 | 1/2005 | Houser et al. | |
| 7,117,695 | B2 * | 10/2006 | Laycock et al. | 66/198 |

FOREIGN PATENT DOCUMENTS

| | | |
|---|---|---|
| EP | 0119536 | 9/1986 |
| EP | 0369822 | 5/1990 |
| EP | 1375717 | 1/2004 |

OTHER PUBLICATIONS

International Search Report for PCT/US2004/017364.
DuPont: "Single Jersey Fabrics with LYCRA" Technical Bulletin L410, Jan. 24, 2001 (Feb. 24, 2001), pp. 1014.
DuPont: "Wet Processing of Fabrics Containing LYCRA Elastane" Technical Bulletin L704, Oct. 15, 1999 (199-10-15), pp. 1-21.
DuPont: "Dyeing and Finishing Circular Knit Fabrics with LYCRA" Technical Bulletin L713 Replaces Bulletin L712, 1999, pp. 1-29.

* cited by examiner

*Primary Examiner*—Danny Worrell
(74) *Attorney, Agent, or Firm*—Christina W. Geerlof

(57) ABSTRACT

Circular knit, elastic fabrics of at least one of single jersey, French terry, and fleece are disclosed that include a bare elastomeric material plated with spun and/or continuous filament hard yarns. The circular knit, elastic fabrics of at least one of single jersey, French terry, and fleece are manufactured by a method that does not require a dry heat setting step. The method requires drafting the bare elastomeric material no more than about 2.5× its original length when knitting to form the circular knit, elastic fabrics of at least one of single jersey, French terry, and fleece.

102 Claims, 5 Drawing Sheets

KNIT BY DESIGN METHOD AND FABRIC

CROSS REFERENCE TO RELATED APPLICATIONS

This application is a continuation-in-part of International Application PCT/US2004/017364, designated in the United States and filed Jun. 1, 2004; which PCT application claims benefit under 35 U.S.C. §365(c) of U.S. application Ser. No. 10/454,746, filed Jun. 2, 2003, now U.S. Pat. No. 6,776,014.

This application is also a continuation-in-part of U.S. application Ser. No. 11/018,003, filed Dec. 21, 2004.

This application also claims benefit under 35 U.S.C. 119(e) of provisional application U.S. Ser. No. 60/668,360 (LP-5755), filed Apr. 4, 2005. The entire contents of each of the above-referenced applications are hereby expressly incorporated herein by reference

STATEMENT REGARDING FEDERALLY SPONSORED RESEARCH OR DEVELOPMENT

Not Applicable.

BACKGROUND OF THE INVENTION

1. Field of the Invention

This invention relates to circular knitting yarns into fabrics, and specifically to circular knit, elastic fabrics of at least one of single jersey, French terry, and fleece comprising both spun and/or continuous filament hard yarns, and bare elastomeric yarns. In particular, the presently claimed and disclosed invention relates to fabrics that have been circular knitted in a manner in which the draft of the bare elastomeric yarn is controlled so as to provide a finished fabric having predefined use characteristics without the need for an additional heat setting step.

2. Brief Description of the Art

Single knit jersey fabrics are broadly used to make underwear and top-weight garments, such as T-shirts. Compared to woven structures, the knit fabric can more easily deform, or stretch, by compressing or elongating the individual knit stitches (comprised of interconnected loops) that form the knit fabric. This ability to stretch by stitch rearrangement adds to the wearing comfort of garments made from knit fabrics. Even when knit fabrics are constructed of 100% hard yarns, such as cotton, polyester, nylon, acrylics or wool, for example, there is some recovery of the knit stitches to their original dimensions after imposed forces are removed. This recovery by knit stitch rearrangement, however, is generally not complete because the hard yarns, which are not elastomeric, do not provide a recovery force sufficient to completely rearrange the knit stitches. As a consequence, single knit fabrics may experience permanent deformations or 'bagging' in certain garment areas where more stretching occurs, such as at the elbows of shirt sleeves, for example.

To improve the recovery performance of circular, single knit fabrics, it is now common to co-knit a small amount of an elastomeric fiber, such as a spandex fiber, with the companion hard yarn.

Traditionally, if heat-setting is not used to "set" the spandex after the fabric is knitted and released from the constraints of the circular knitting machine, the stretched spandex in the fabric will retract to compress the fabric stitches so that the fabric is reduced in dimensions compared to what those dimensions would be if the spandex were not present.

Heat setting is not used for all varieties of weft knit elastic fabrics. In some cases a heavy knit will be desired, such as in double knits/ribs and flat sweater knits. In these cases, some stitch compression by the spandex is acceptable. In other cases, the bare spandex fiber is covered with natural or synthetic fibers in a core-spinning or spindle-covering operation, so that the recovery of the spandex and resultant stitch compression is restrained by the covering. In still other cases, bare or covered spandex is plated only on every second or third knit course, thereby limiting the total recovery forces that compress the knit stitches. In seamless knitting, a process wherein tubular knits are shaped for direct use while being knitted on special machines, the fabric is not heat set because dense, stretchy fabric is intended. For circular knit, elastic single jersey fabrics made for cutting and sewing, however, wherein bare spandex is plated in every course, heat setting is almost always required.

Heat setting has several disadvantages. Heat setting is an extra cost to finish knit elastic fabrics that contain spandex, versus fabrics that are not elastic (rigid fabrics). Moreover, high spandex heat setting temperatures can adversely affect sensitive companion hard yarns, e.g., yellowing of cotton, thereby requiring more aggressive subsequent finishing operations, such as bleaching. Aggressive bleaching can negatively affect fabric tactile properties, for example, the "hand" of the fabric, and usually requires the manufacturer to include fabric softener to counteract bleaching. Furthermore, certain fibers cannot withstand high temperature heat treatment. Heat-sensitive hard yarns, such as those from polyacryonitrile, wool and acetate, cannot be used in high temperatures spandex heat setting steps, because the high heat setting temperatures will adversely affect such heat-sensitive yarns. Finally, other fibers are sensitive to heat due to low fiber melting point. Polypropylene, for example, has a softening point of 155° C., which renders it unsuitable for fabric processing which requires heat setting.

The disadvantages of heat setting have long been recognized, and, as a result, spandex compositions that heat-set at somewhat lower temperatures have been identified (U.S. Pat. Nos. 5,948,875 and 6,472,494, both of which are hereby expressly incorporated herein by reference in their entirety). For example, the spandex defined in U.S. Pat. No. 6,472,494 has a heat set efficiency greater than or equal to 85% at approximately 175° C.-190° C. The heat set efficiency value of 85% is considered a minimum value for effective heat setting. It is measured by laboratory tests comparing the length of stretched spandex before and after heat setting to the before-stretched spandex length. While such lower heat setting spandex compositions provide an improvement, heat setting is still required, and the costs associated with it have not been significantly reduced.

The traditional practice of making and heat setting circular knit fabrics has further disadvantages. The knit fabric emerges from a circular knitting machine in the form of a continuous tube. As the tube is formed in knitting, it is either rolled under tension onto a mandrel, or it is collected as a flat tube under the knitting machine by plaiting, or loose folding. In either case, the fabric establishes two permanent creases where the fabric tube has been folded or flattened. Although the fabric is "opened" by slitting the fabric tube along one of the creases, subsequent use and cutting of the fabric usually mutt avoid the remaining crease. This reduces the fabric yield (or the amount of knit fabric that can be further processed into garments).

In view of the foregoing disadvantages, methods are needed for making circular knit, elastic fabrics of at least one of single jersey, French terry and fleece that have bare elastomeric material plated with spun and/or continuous filament hard yarns, and that avoid the costs and disadvantages associated with the prior art heat setting methods. Additionally, the-invention allows circular knit, elastic fabrics of at least one of single jersey, French terry and fleece to be formed (stabilized, dyed, and finished) as a tube, which has material usage advantages over the prior art.

SUMMARY OF THE INVENTION

The invention provides circular knit, elastic fabrics of at least one of single jersey, French terry, and fleece that include bare elastomeric material plated with spun and/or continuous filament hard yarns; wherein the circular knit, elastic fabrics of at least one of single jersey, French terry and fleece are manufactured with commercially acceptable properties without a need for in-fabric elastomeric fiber dry heat setting. In one embodiment of the invention, (1) the elastomeric fiber draft can be limited during the knitting process; and (2) certain desired single knit jersey fabric parameters can be maintained.

The first aspect of the invention includes a method for making circular knit, elastic fabrics of at least one of single jersey, French terry, and fleece in which bare elastomeric material, such as a bare spandex yarn, from 15 to 156 dtex, for example from 22 to 78 dtex, can be plated with at least one hard yarn of spun and/or continuous filament yarn, or blends thereof, with yarn count (Ne) from 10 to 85, for example from 20 to 68.

The elastomeric material and the at least one hard yarn can be plated in every knit course. The circular knit, elastic fabrics of at least one of single jersey, French terry, and fleece produced by this knitting method can have a cover factor of from 1.05 to 1.9, for example from about 1.14 to about 1.6. During the knitting, the draft on the elastomeric material feed can be controlled so that the elastomeric material can be drafted no more than 2.5× its original length when knit to form the circular knit, elastic fabric.

In addition, the circular knit, elastic fabric can be exposed to at least one further treatment step, such as a finishing and/or drying step, without heat setting the fabric or the elastomeric material within the fabric. The elastomeric material is heat set within a heat setting efficiency of at least about 85% at a heat setting temperature, and therefore the circular knit, elastic fabric can be exposed to temperatures below the heat setting temperature of the elastomeric material to prevent dry heat setting. Finishing may comprise one or more steps, such as cleaning, bleaching, dyeing, drying, and compacting, and any combination of such steps. Finishing also may comprise napping. The finishing and drying can be carried out at one or more temperatures below 160° C. Drying or compacting can be carried out while the circular knit, elastic fabric is in an overfeed condition in the warp direction.

The resulting circular knit, elastic fabric can have an elastomeric material content of from about 3.5% to about 30% by weight based on the total fabric weight per square meter, for example from about 3.5% to about 27% by weight based on the total fabric weight per square meter. In addition, such circular knit, elastic fabric can have a cover factor of from about 1.05 to about 1.9, for example, about 1.4.

The second and third aspects of the invention include the circular knit, elastic fabrics of at least one of single jersey, French terry and fleece made according to the inventive method, and garments constructed from such fabrics. The circular knit, elastic fabric produced by the inventive method can be formed with hard yarns of synthetic filaments, cotton, or cotton blends and has a basis weight of from about 140 to about 500 g/m$^2$, for example of from about 170 to about 300 g/m$^2$. The circular knit, elastic fabric also has an elongation of about 45% to about 175%, for example from about 60% to about 175% in the length (warp) direction, and a shrinkage after washing and drying of about 15% or less, typically, 14% or less, for example less than about 7% in both length and width. The circular knit, elastic fabric may be exposed to a temperature no higher than about 135° C. (as shown by molecular weight analysis or differential scanning calorimetry). The circular knit, elastic fabric may be in the form of a tube (as output from a circular knitting process), or in the form of a flat knit. The fabric tube may be slit to provide a flat fabric. The circular knit, elastic fabric typically has a curling value of about 1.0 or less, for example about 0.5 or less face curl. Garments may include swimwear, underwear, t-shirts, and top or bottom-weight garments, such as for ready-to-wear, athletic or outdoor wear.

Another aspect of the present invention is to provide a bare elastomeric material-containing fabric containing the elastomeric fiber in every knit course with substantially high resistance to degradation by chlorine such that the fabric has durability to a chlorine pool which is similar to spandex fabrics made with specially formulated chlorine resistant spandex (see U.S. Pat. No. 6,846,866). The fabric may have an Xrel of at least about 7. The fabric may be in the form of a tube (as output from a circular knitting process) or in the form of a flat knit. The fabric tube may be slit to provide a flat fabric.

The present invention provides a circular knit, elastic fabric of at least one of single jersey, French terry and fleece having at least one elastomeric material incorporated therein, wherein the at least one elastomeric material can be drafted no more than about 2.5× its original length.

The present invention further provides a method for producing a circular knit, elastic fabric of at least one of single jersey, French terry and fleece having at least one elastomeric material incorporated therein, wherein the method involves drafting the at least one elastomeric material no more than about 2.5× its original length, and wherein the method may or mat not include a dry heat setting step. And additional heat setting step may be used.

The present invention further provides a circular knit, elastic fabric of at least one of single jersey, French terry and fleece having at least one elastomeric material incorporated therein, wherein the circular knit, elastic fabric may be produced in the form of a tube and may have no visible side creases formed therein, and wherein the entire portion of the circular knit, elastic fabric may have no creases and can be useable for cutting and sewing such fabric into garments. Accordingly, the invention provides, a circular knit, elastic fabric of at least one of single jersey, French terry and fleece formed of a heat sensitive hard yarn and at least one elastomeric material incorporated therein.

Other features and advantages of the present invention will become apparent from the following detailed description when read in conjunction with the accompanying drawings and appended claims.

DETAILED DESCRIPTION OF THE INVENTION

Figure 1:
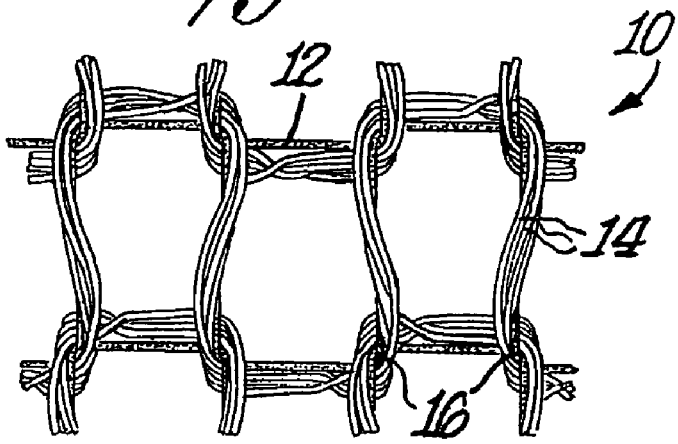
FIG. 1 is a schematic diagram of plated knit stitches comprising a hard yarn and spandex.

Before explaining at least one embodiment of the invention in detail by way of exemplary drawings, experimentation, results, and laboratory procedures, it is to be understood that the invention is not limited in its application to the details of construction and the arrangement of the components set forth in the following description or illustrated in the drawings, experimentation and/or results. The invention is capable of other embodiments or of being practiced or carried out in various ways. As such, the language used herein is intended to be given the broadest possible scope and meaning; and the embodiments are meant to be exemplary—not exhaustive. Also, it is to be understood that the phraseology and terminology employed herein is for the purpose of description and should not be regarded as limiting.

The terms "elastomeric material" or "elastomer" as used herein will be understood to refer to a synthetic material that has the excellent stretchability and recovery of natural rubber such that the material is capable of repeated stretching to at least twice its original length, as well as immediate and forcible recovery to its approximate original length upon release of stress. The "elastomeric material" is generally a manufactured fiber in which the fiber forming substance is a long chain synthetic polymer having segmented polyurethane. Examples of elastomeric materials that may be utilized in accordance with the present invention include, but are not limited to, spandex, elastane, anidex, elastoester, bi-constituent filament rubber, and combinations thereof.

As used herein, "spandex" means a manufactured fiber in which the fiber-forming substance is a long-chain synthetic polymer comprised of at least 85% of a segmented polyurethane. The polyurethane is prepared from a polyether glycol, a mixture of diisocyanates, and a chain extender and then melt-spun, dry-spun or wet-spun to form the spandex fiber. The spandex preferably is a commercially available elastane product for circular knitting, such as Lycra® types T162B, T162C, T165C, T169B and T562.

The term "denier" as used herein will be understood to be a relative measure of a linear density (or fineness) of a fiber or yarn. Denier is equivalent numerically to the weight in grams per 9,000 meters length of the material. The term "decitex" as used herein will be understood to be equivalent to the weight in grams of a 10,000 meter length of the material.

The term "draft" as used herein refers to the amount of stretch applied to a strand of elastomeric material, such as spandex, resulting in a reduction in linear density of the strand of elastomeric material. The draft of a fiber is directly related to the elongation (stretching) applied to the fiber. For example, 100% elongation corresponds to 2× draft, and 200% elongation corresponds to 3× draft, etc.

The term "hard yarns" as used herein will be understood to refer to knitting yarns which do not contain a high amount of elastic stretch, such as natural and/or synthetic spun staple yarns, natural and/or synthetic continuous filament yarns, and combinations thereof. Examples of materials that may be utilized in the spun staple and/or continuous filament hard yarns in accordance with the present invention include, but are not limited to, cotton, polyester, nylon, polypropylene, polyethylene, acrylics, wool, acetate, polyacryonitrile, and combinations thereof. Natural fibers as used herein will be understood to refer to fibers such as cellulosic (i.e. cotton, bamboo) or protein (i.e. wool, silk, soybean) fibers.

The term "hard yarn count" as used herein will be understood to refer to a measure of the fineness or linear density of a yarn. Hard Yarn Count may be expressed in indirect units (length per unit of weight or mass) or direct units (weight per unit of length). In one embodiment, hard yarn count is represented as "Ne" in the English system of measurement and as "Nm" in the Metric system of measurement.

As used herein, the term "warp direction" refers to the length direction of the fabric, and the term "weft direction" refers to the width direction of the fabric.

The term "Cover Factor" as used herein will be understood to refer to the ratio of fabric surface occupied by yarns to total fabric surface. The Cover Factor is a relative measure of the openness of each knit stitch that characterizes the structural design of a circular knit fabric. This "openness" is related to the percentage of the area that is open versus that which is covered by the yarn in each stitch. The calculation of the Cover Factor is described in further detail herein below.

For knit constructions in circular knit machines, the process of co-knitting spandex is called "plating." With plating, the hard yarn and the bare spandex yarn are knitted in parallel, side-by-side relation, with the spandex yarn always kept on one side of the hard yarn, and hence on one side of the knitted fabric. FIG. 1 is a schematic illustration of plated knit stitches 10 wherein the knitted yarn comprises spandex 12 and a multi-filament hard yarn 14. When spandex is plated with hard yarn to form a knit fabric, additional processing costs are incurred beyond the added cost of the spandex fiber. For example, fabric stretching and heat setting usually are required in the finishing steps when making circular knit elastic single jersey fabrics.

By "circular knitting" is meant a form of weft knitting in which the knitting needles are organized into a circular knitting bed. Generally, a cylinder rotates and interacts with a cam to move the needles-reciprocally for knitting action. The yarns to be knitted are fed from packages to a carrier plate that directs the yarn strands to the needles. The circular knit fabric emerges from the knitting needles in a tubular form through the center of the cylinder.

Figure 4:
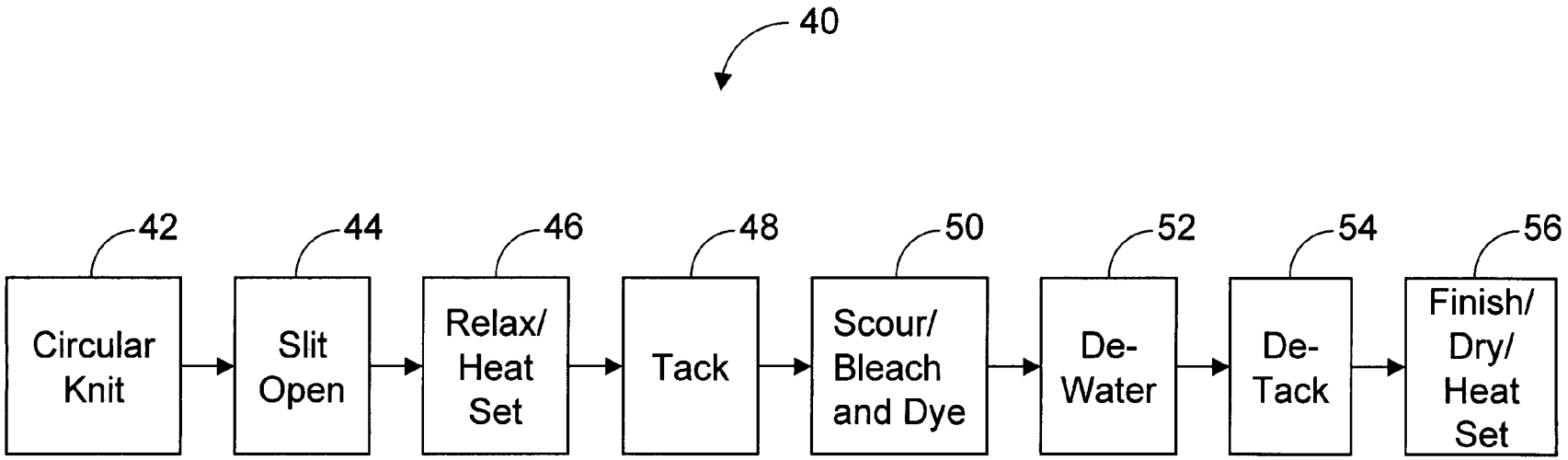
FIG. 4 is a flow chart showing prior art process steps for making circular knit, elastic fabrics that have bare spandex plated in every knit course.

The steps for making elastic circular knit fabrics according to one known process 40 are outlined in FIG. 4. Although process variations exist for different fabric knit constructions and fabric end uses; the steps shown in FIG. 4 are representative for making jersey knit elastic fabrics with spun hard yarns, such as but not limited to, cotton. The fabric is first circular knit 42 at conditions of high spandex draft and feed tensions. For example, for single jersey fabrics made with bare spandex plated in every knit course, the known feed tension range is 2 to 4 cN for 22 dtex spandex; 3 to 5 cN for 33 dtex; and 4 to 6 cN for 44 dtex (DuPont Technical Bulletin L410). The fabric is knit in the form of a tube, which is collected under the knitting machine either on a rotating mandrel as a flattened tube, or in a box after it is loosely folded back and forth (i e., "plaited").

In open-width finishing, the knitted tube is then slit open 44 and laid flat. The open fabric is subsequently relaxed 46, either by subjecting it to steam, or by wetting it by dipping and squeezing (padding). The relaxed fabric is then applied to a tenter frame and heated (for heat setting 46) in an oven. The tenter frame holds the fabric on the edges by pins, and stretches it in both the length and width directions in order to return the fabric to desired dimensions and basis weight. This heat setting is accomplished before subsequent wet processing steps and, consequently, heat setting is often referred to as "pre-setting" in the trade. At the oven exit, the flat fabric is released from the stretcher and then tacked 48 (sewed) back into a tubular shape. The fabric then is processed in tubular form through wet processes 50 of cleaning (scouring) and optional bleaching/dyeing, e.g., by soft-flow jet equipment, and then dewatered 52, e.g., by squeeze rolls or in a centrifuge. The fabric is then "de-tacked" 54 by removing the sewing thread and re-opening the fabric into a flat sheet. The flat, still wet, fabric is then dried and heatset 56 in a tenter-frame oven under conditions of fabric overfeed (opposite of stretching) so that the fabric is under no tension in the length (machine) direction while being dried at temperatures below heat-setting temperatures. The fabric is slightly tensioned in the width direction in order to flatten any potential wrinkling. An optional fabric finish, such as a softener, may be applied just prior to the drying/heatsetting operation 56. In some cases, a fabric finish is applied after the fabric is first dried by a belt or tenter-frame oven, so that the finish is taken up uniformly by fibers that are equally dry. This extra step involves re-wetting the dried fabric with a finish, and then drying the fabric again in a tenter-frame oven.

Heat setting of dry fabric in a tenter frame or other drying apparatus "sets" spandex in an elongated form. This is also known as re-deniering, wherein a spandex of higher denier is drafted, or stretched, to a lower denier, and then heated to a sufficiently high temperature, for a sufficient time, to stabilize the spandex at the lower denier. Heat setting therefore means that the spandex permanently changes at a molecular level so that recovery tension in the stretched spandex is mostly relieved and the spandex becomes stable at a new and lower denier. Heat setting temperatures for spandex are generally in the range of about 175° C. to about 200° C. For the widely known prior art process 40 shown in FIG. 4, the heat setting 46 commonly is for about 45 seconds or more at about 190° C.

Compression of the stitches in the knitted fabric has three major effects that are directly related to elastic knit fabric properties, and thereby usually renders the fabric inappropriate for subsequent cut and sew operations.

First, stitch compression reduces fabric dimensions and increases fabric basis weight (g/m$^2$) beyond desired ranges for circular knit, elastic fabrics for use in garments. As a result, the traditional finishing process for elastic circular knit fabric includes a fabric stretching and heating step, which occurs at sufficiently high temperatures and sufficiently long residence time, so that the spandex yarn in the knit will "set" at desired stretched dimensions. After heat setting, the spandex yarn will either not retract, or will retract only modestly below its heat-set dimension. Thus, the heat-set spandex yarn will not significantly compress the knit stitches from the heat-set dimensions. Stretching and heat setting parameters are chosen to yield the desired fabric basis weight and elongation, within relatively tight limits. For a typical cotton-jersey elastic single knit, the desired elongation is at least 45%, and the basis weight ranges from about 140 to about 500 g/m$^2$.

Second, the more severe the stitch compression, the more the fabric will elongate on a percentage basis, thus far exceeding minimum standards and practical needs. When a plated knit with elastic yarn is compared with a fabric knit without elastic yarn, it is common for the plated elastic knit fabric to be 50% shorter (more compressed) than the fabric without elastic yarn. The plated knit is able to stretch in length 150% or more from this compressed state, and such excessive elongation is generally undesirable in jersey knits for cut and sew applications. This length is in the warp direction of the fabric. Fabrics with high elongation in length (stretch) are more likely to be cut irregularly, and are also more likely to shrink excessively upon washing. Similarly, stitches are compressed by spandex in the width direction, so that fabric width is reduced about 50% as well, far beyond the 15 to 20% as-knit width reduction normally encountered with rigid (non-elastic) fabrics.

Third, the compressed stitches in the finished fabric are at an equilibrium condition between spandex recovery forces and resistance to stitch compression by the companion hard yarn. Washing and drying of the fabric can reduce the hard-yarn resistance, probably in part because of agitation of the fabric. Thus, washing and drying may permit the spandex recovery forces to further compress the knit stitches, which can result in unacceptable levels of fabric shrinkage. Heat-setting the knit fabric serves to relax the spandex and reduce the spandex recovery force. The heat setting operation therefore improves the stability of the fabric, and reduces the amount that the fabric will shrink after repeated washings.

The subject of the presently disclosed and claimed invention is circular knitting and, in particular, the manufacture of specific circular knit, elastic fabrics of at least one of single jersey, French terry and fleece for subsequent 'cut and sew' use. These circular knit, elastic fabrics of at least one of single jersey, French terry and fleece are formed of an elastomeric material and a hard yarn, wherein the elastomeric material is drafted no more than about 2.5× and the knit elastic fabric is not dry heat set.

The presently disclosed and claimed invention also relates to a process for making circular knit, elastic, fabric of at least one of single jersey, French terry and To fleece comprising spandex and polypropylene hard yarns without requiring heat setting. Since polypropylene fibers cannot be heatset at temperatures required to permanently deform the spandex, the present invention represents a novel method of fabricating spandex-polypropylene knit fabrics. The resulting fabric has superior performance relative to known fabrics in terms of achieving fabric basis weight of about 140 g/m$^2$ to about 400 g/m$^2$ with reduced fabric shrinkage and acceptable fabric elongation. These fabrics have good chlorine durability when compared to the state of the art spandex containing fabrics.

The presently disclosed invention also includes single knit French terry and fleece fabrics. These fabrics can be made and finished without heat setting when the draft on the elastomer is kept to about 2.5× or below during circular knitting.

Figure 2:
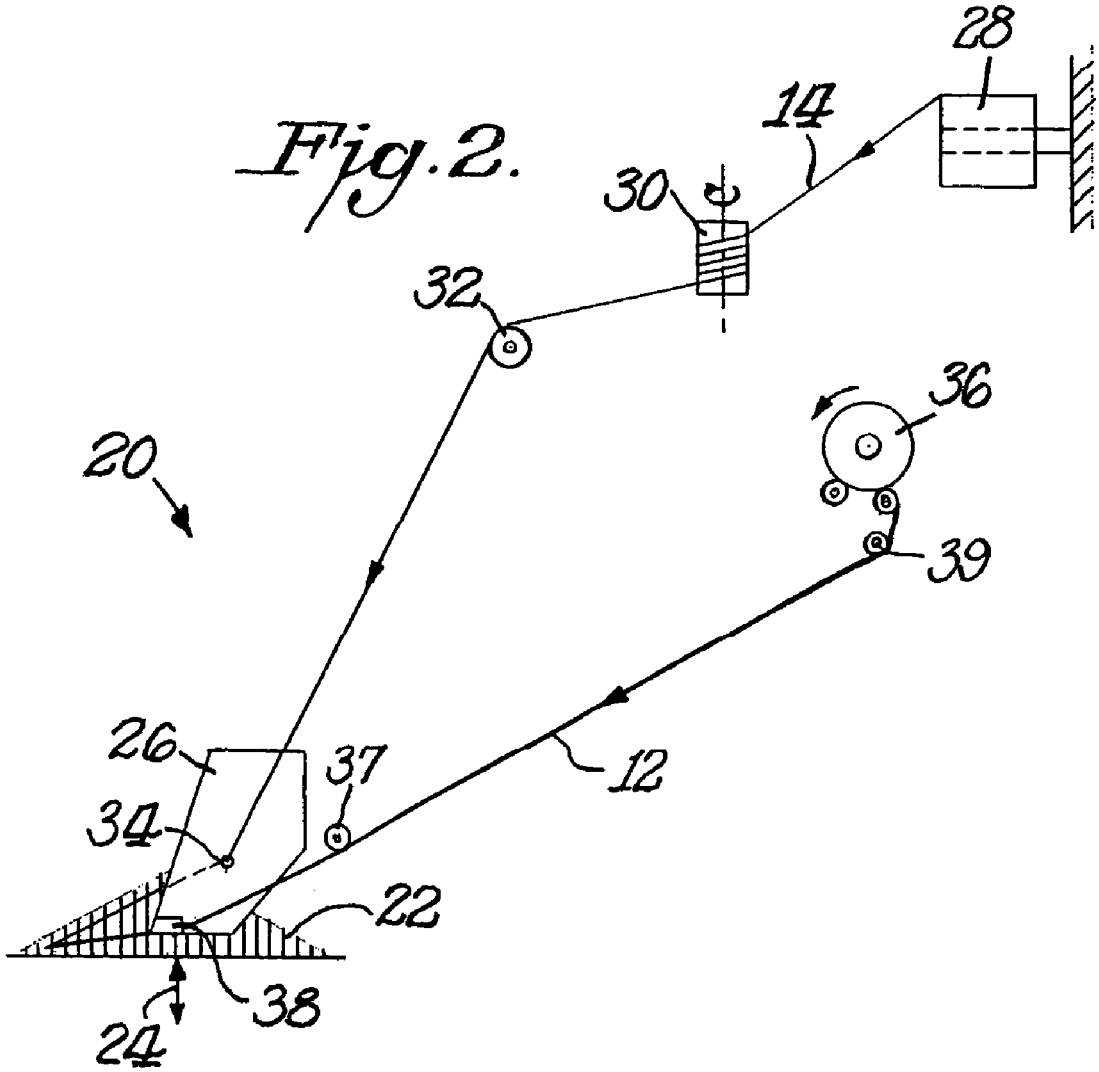
FIG. 2 is a schematic diagram of a portion of a circular knitting machine fed with a spandex feed and a hard yarn feed.

Regarding circular knitting, FIG. 2 shows in schematic form one feed position 20 of a circular knitting machine having a series of knitting needles 22 that move reciprocally as indicated by the arrow 24 in response to a cam (not shown) below a rotating cylinder (not shown) that holds the needles. In a circular knitting machine, there are multiple numbers of these feed positions arranged in a circle, so as to feed individual knitting positions as-the knitting needles, carried by the moving cylinder, are rotated past the positions.

For plating knit operations, a spandex yarn 12 and a hard yarn 14 are delivered to the knitting needles 22 by a carrier plate 26. The carrier plate 26 simultaneously directs both yarns to the knitting position. The spandex yarn 12 and hard yarn 14 are introduced to the knitting needles 22 at the same or at a similar rate to form a single jersey knit stitch 10 like that shown in FIG. 1.

While the Figures may be described herein in conjunction with the use of spandex yarn, it is to be understood that the use of spandex yarn in the following description is for exemplary purposes only, and thus the present invention is not limited to the use of spandex. Rather, any elastomeric material may be substituted for spandex in the present invention and fall within the scope of the present invention. While the use of another elastomeric material may require parameters that fall outside the ranges described herein, it is to be understood that a person of ordinary skill in the art could easily ascertain the required parameters for the substitute elastomeric material given the teachings and disclosure of the present specification, and therefore such parameters fall well within the scope and teachings of the presently claimed and disclosed invention.

The hard yarn 14 is delivered from a wound yarn package 28 to an accumulator 30 that meters the yarn to the carrier plate 26 and knitting needles 22. The hard yarn 14 passes over a feed roll 32 and through a guide hole 34 in the carrier plate 26. Optionally, more than one hard yarn may be delivered to the knitting needles via different guide holes in the carrier plate 26. For French terry fabric construction of the claimed invention, two hard yarns are knitted with one elastomeric yarn. One hard yarn is plated with the elastomeric yarn as in FIG. 2 and a second hard yarn is laid into the fabric. As such, the plated jersey and the terry yarn are feeding into the machine alternately. The formation of a French terry fabric is well known to those skilled in the art.

The spandex 12 is delivered from a surface driven package 36 and past a broken end detector 39 and change of direction roll(s) 37 to a guide slot 38 within the carrier plate 26. The feed tension of the spandex 12 is measured between the detector 39 and drive roll 37, or alternatively between the surface driven package 36 and roll 37 if the broken end detector is not used. The guide hole 34 and guide slot 38 are separated from one another in the carrier plate 26 so as to present the hard yarn 14 and spandex 12 to the knitting needles 22 in side by side, generally parallel relation (plated).

The spandex stretches (drafts) when it is delivered from the supply package to the carrier plate and in turn to the knit stitch due to the difference between the stitch use rate and the feed rate from the spandex supply package. The ratio of the hard yarn supply rate (meters/min) to the spandex supply rate is normally from about 2.5 to about 4 times (2.5× to 4×) greater, and is known as the machine draft. This corresponds to spandex elongation of from about 150% to about 300%, or more. The feed tension in the spandex yarn is directly related to the draft (elongation) of the spandex yarn. This feed tension is typically maintained at values consistent with high machine drafts for the spandex.

The present invention has identified that improved results are obtained over the prior art when the total spandex draft, as measured in the fabric, is kept to about 2.5× or less. This draft value is the total draft of the spandex, which includes any drafting or drawing of the spandex that is included in the supply package of as-spun yarn. The value of residual draft from spinning is termed package relaxation, "PR", and it typically ranges from about 0.05 to about 0.15 for the spandex used in circular knit, elastic fabrics of at least one of single jersey, French terry and fleece. The total draft of the spandex in the fabric is therefore MD*(1+PR), where "MD" is the knitting machine draft. The knitting machine draft is the ratio of hard yarn feed rate to spandex feed rate, both from their respective supply packages.

Because of its stress-strain properties, spandex yarn drafts (draws) more as the tension applied to the spandex increases; conversely, the more that the spandex is drafted, the higher the tension in the yarn. A typical spandex yarn path, in a circular knitting machine, is schematically shown in FIG. 2. The spandex yarn 12 is metered from the supply package 36, over or through a broken end detector 39, over one or more change-of-direction rolls 37, and then to the carrier plate 26, which guides the spandex to the knitting needles 22 and into the stitch. There is a build-up of tension in the spandex yarn as it passes from the supply package and over each device or roller, due to frictional forces imparted by each device or roller that touches the spandex. The total draft of the spandex at the stitch is therefore related to the sum of the tensions throughout the spandex path.

The spandex feed tension is measured between the broken end detector 39 and the roll 37 shown in FIG. 2. Alternatively, the spandex feed tension is measured between the surface driven package 36 and roll 37 if the broken end detector 39 is not used. The higher this tension is set and controlled, the greater the spandex draft will be in the fabric, and vice versa. The prior art teaches that this feed tension should range from about 2 to about 4 cN for 22 dtex spandex, and from about 4 to about 6 cN for 44 dtex spandex in commercial circular knitting machines. With these feed tension settings and the additional tensions imposed by subsequent yarn-path friction, the spandex in commercial knitting machines will be drafted significantly more than about 2.5×.

The presently disclosed and claimed invention does not anticipate all the ways that spandex friction can be minimized between the supply package and the knit stitch. The method requires, however, that friction be minimized in order to keep the spandex feed tensions sufficiently high for reliable spandex feeding while at the same time maintaining the spandex draft to about 2.5× or less.

Figure 5:
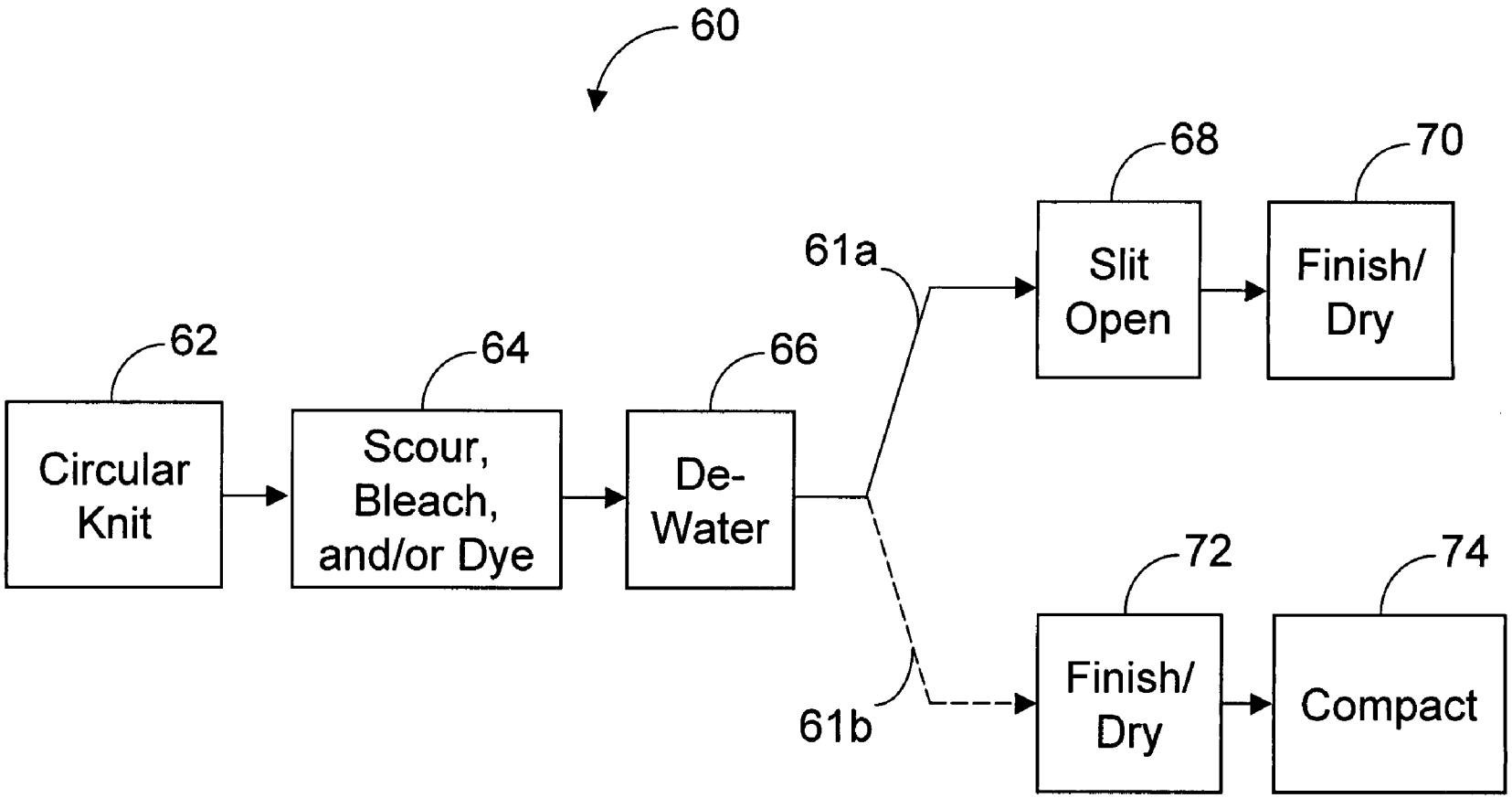
FIG. 5 is a flow chart showing the inventive process steps for making circular knit, elastic fabrics of at least one of single jersey, French terry and fleece that have bare spandex plated in every knit course of one embodiment of the present invention.

After knitting a circular knit, elastic fabric of plated spandex with hard yarn per the method of the presently disclosed and claimed invention, such fabric is finished in either of the alternate processes 60 illustrated diagrammatically in FIG. 5. Drying operations can be carried out on circular knit, elastic fabric 62 in the form of an open width web (top row of diagram, path 61*a*), or as a tube (bottom row of diagram, path 61*b*). For either of these paths, wet finishing process steps 64 (such as scouring, bleaching and/or dyeing) are carried out on the circular knit, elastic fabric while it is in the tubular form. One form of dyeing, called soft-flow jet dyeing, usually imparts tension and some length deformation in the circular knit, elastic fabric. Care should be taken to minimize any additional tension applied during fabric processing and transport from wet finishing to the dryer, and also enable the circular knit, elastic fabric to relax and recover from such wet-finishing and transport tensions during drying.

Following wet finishing process steps 64, the circular knit, elastic fabric is dewatered 66, such as by squeezing or centrifuging. In process path 61*a*, the tubular fabric is then slit open 68 before it is delivered to a finish/dry step 70 for optional finish application (e.g., softener by padding) and subsequent drying in a tenter-frame oven under conditions of fabric length overfeed. In process path 61*b*, the tubular fabric is not slit open, but is sent as a tube to the finish/dry step 72. Finish, such as softener, can be optionally applied by padding. The tubular fabric is sent through a drying oven, e.g., laid on a belt, and then to a compactor to separately provide fabric overfeed. A compactor commonly uses rolls to transport the fabric, usually in a steam atmosphere. The first roll(s), is driven at a faster speed of rotation than the second roll(s) so that the fabric has an overfeed. Generally, the steam does not "re-wet" the fabric so that no additional drying is required after compacting.

The drying step 70 (path 61*a*) or the compacting step 74 (path 61*b*) is operated with controlled, high fabric overfeed in the length (machine) direction so that the fabric stitches are free to move and rearrange without tension. A flat, non-wrinkled or non-buckled fabric emerges after drying. These techniques are familiar to those skilled in the art. For open width fabrics, a tenter-frame is used to provide fabric overfeed during drying. For tubular fabrics, forced overfeed is typically provided in a compactor 74, after belt drying. In either open-width or tubular fabric processing, the fabric drying temperature and residence time are set below the values required to heat set the spandex.

Figure 6:
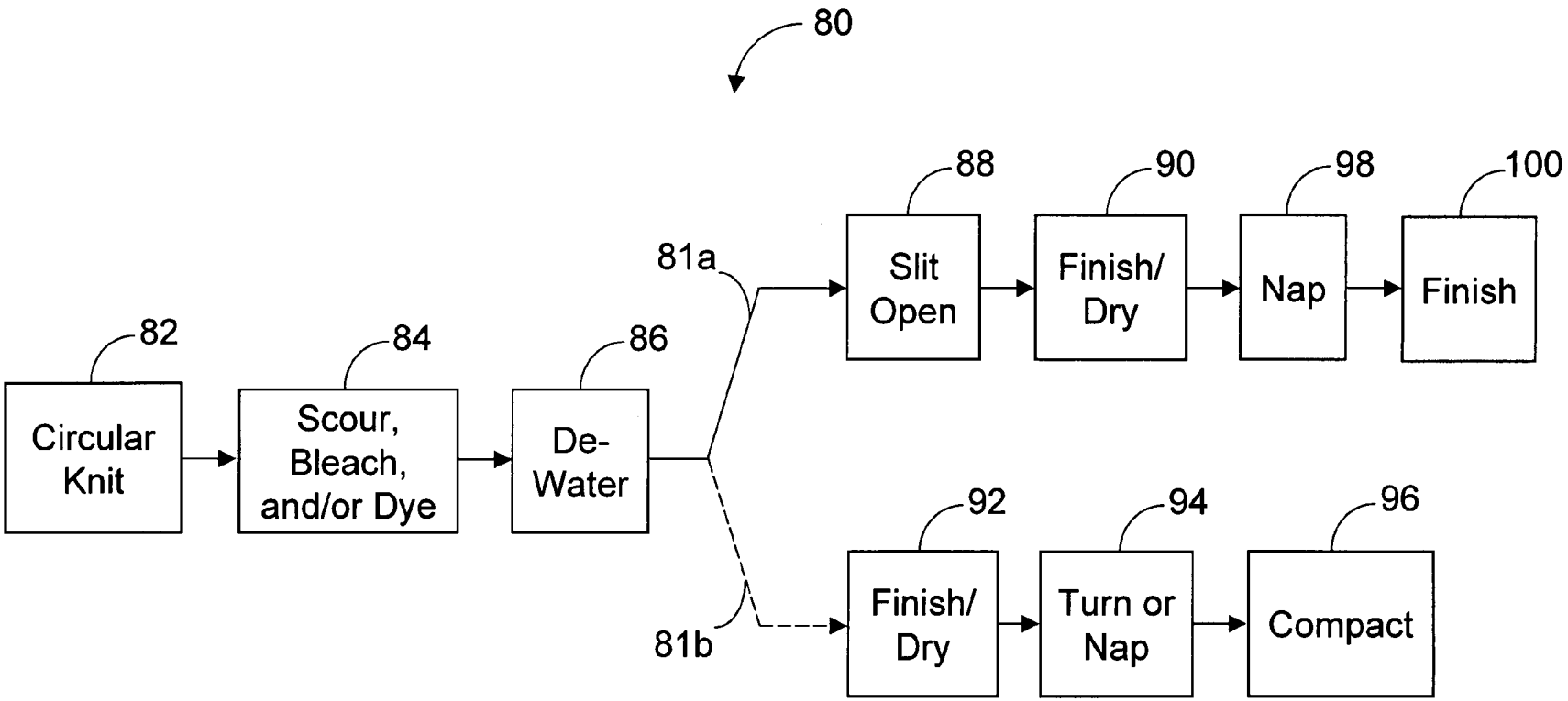
FIG. 6 is a flow chart showing the inventive process steps for making circular knit, elastic fabric of at least one of single jersey, French terry and fleece that have bare spandex plated in alternate knit courses of one embodiment of the present invention.

After knitting a circular knit, elastic, French terry fabric of plated spandex with hard yarns per the method of the presently disclosed and claimed invention, such fabric is finished in either of the alternate processes 80 illustrated diagrammatically in FIG. 6. Drying and finishing operations can be carried out on circular knit, elastic, French terry fabric 82 in the form of an open width web (top row of diagram, path 81*a*), or as a tube (bottom row of diagram, path 81*b*). For either of these paths, wet finishing process steps 84 (such as scouring, bleaching and/or dyeing) are carried out on the circular knit, elastic, French terry fabric while it is in the tubular form. One form of dyeing, called soft-flow jet dyeing; usually imparts tension and some length deformation in the circular knit, elastic, French terry fabric. Care should be taken to minimize any additional tension applied during fabric processing and transport from wet finishing to the dryer, and also enable the circular knit, elastic, French terry fabric to relax and recover from such wet-finishing and transport tensions during drying.

Following wet finishing process steps 84, the circular knit, elastic, single jersey fabric is dewatered 86, such as by squeezing or centrifuging. In process path 81*a*, the tubular fabric is then slit open 88 before it is delivered to a finish/dry step 70 for optional finish application (e.g., softener or nap assist by padding) and subsequent drying in a tenter-frame oven under conditions of fabric length overfeed. The drying step 90 is followed by a napping step 98 and a final finishing pass through a tenter frame 100 for fleece fabrics. For French terry finished fabrics, the napping 98 and final finishing steps 100 are not required. In process path 81*b*, the tubular fabric is not slit open, but is sent as a tube to the finish/dry step 92. Finish, such as softener or nap assist, can be optionally applied by padding. The tubular fabric is sent through a drying oven, e.g., laid on a belt. For fleece fabrics, drying is followed by a napping step 94 and a final compacting step 96. For French terry fabrics, the tube of fabric is turned inside out 94 and compacted 96.

The drying step 90 (path 81*a*) or the compacting step 96 (path 81*b*) is operated with controlled, high fabric overfeed in the length (machine) direction so that the fabric stitches are free to move and rearrange without tension. A flat, non-wrinkled or non-buckled fabric emerges after drying. These techniques are familiar to those skilled in the art. For open width fabrics, a tenter-frame is used to provide fabric overfeed during drying. For tubular fabrics, forced overfeed is typically provided in a compactor 96, after turning or napping. In either open-width or tubular fabric processing, the fabric drying temperature and residence time are set below the values required to heat set the spandex.

Figure 3:
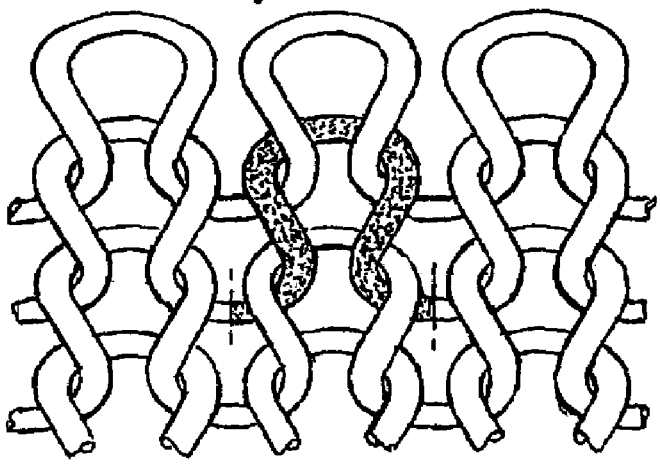
FIG. 3 is a schematic diagram illustrating a series of single jersey knit stitches and highlighting one stitch of stitch length "L".

The structural design of a circular knit, elastic fabric can be characterized in part by the "openness" of each knit stitch. This "openness" is related to the percentage of the area that is open versus that which is covered by the yarn in each stitch (see, e.g., FIGS. 1 and 3), and is thus related to fabric basis weight and elongation potential. For rigid, non-elastic weft knit fabrics, the Cover Factor ("Cf") is well known as a relative measure of openness. The Cover Factor is a ratio and is defined as:

$$Cf=\sqrt{(\text{tex})}\div L$$

where tex is the grams weight of 1000 meters of the hard yarn, and L is the stitch length in millimeters. FIG. 3 is a schematic of a single knit jersey stitch pattern. One of the stitches in the pattern has been highlighted to show how the stitch length, "L" is defined. For yarns of metric count Nm, the tex is 1000÷Nm, and the Cover Factor is alternatively expressed as follows:

$$Cf=\sqrt{(1000/\text{Nm})}\div L.$$

The presently disclosed and claimed invention describes, in one embodiment, the production of commercially useful circular knit, elastic fabrics of at least one of single jersey, French terry, and fleece plated from bare elastomeric material, such as bare spandex, and at least one hard yarn that are produced without heat setting by maintaining the elastomeric material draft at about 2.5× or less, and by designing and manufacturing the knit fabric within the following guidelines:

- The Cover Factor, which characterizes the openness of the knit structure, is between about 1.05 and about 1.9, and is for example from about 1.14 to about 1.6;
- The hard yarn count, Ne, is from about 10 to about 85, for example from about 20 to about 68;
- The elastomeric material has from about 15 to about 156 dtex, for example from about 22 to about 78 dtex;
- The content of elastomeric material in the circular knit, elastic fabric, on a % weight basis, is from about 3.5% to about 30%, and is for example from about 3.5% to about 27%;
- The circular knit, elastic fabric so formed has a shrinkage after washing and drying of about 15% or less, typically, 14% or less, for example 7% or less in both the length and width directions;
- The circular knit, elastic fabric has an elongation of about 45% to about 175%, for example from about 60% to about 175%, in the length (warp) direction; and
- The hard yarn is a synthetic filament (such as polypropylene or polyester), spun staple yarn of natural fibers, natural fibers blended with synthetic fibers or yarns (such as polypropylene or polyester), spun staple yarn of cotton, cotton blended with synthetic fibers or yarns (such as polypropylene or polyester), spun staple polypropylene, polyethylene or polyester blended with polypropylene, polyethylene or polyester fibers or yarns, and combinations thereof.

While not wishing to be bound by any one theory, it is believed that the hard yarn in the knit structure resists the spandex force that acts to compress the knit stitch. The effectiveness of this resistance is related to the knit structure, as defined by the Cover Factor. For a given hard yarn count, Ne, the Cover Factor is inversely proportional to the stitch length, L. This length is adjustable on the knitting machine, and is therefore a key variable for control.

Because the elastomeric material is not heat set in the process of the invention, the elastomeric material draft should be the same in the circular knit, elastic, single jersey, French terry, and fleece as-knit fabric, the finished fabric, or at fabric-processing steps in-between, within the limits of measurement error.

For circular knit, elastic, single jersey, French Terry, and fleece fabrics, the appropriate gauge of knitting machine is selected according to prior art relationships between hard yarn count and knitting machine gauge. Choice of gauge can be used to optimize circular knit, elastic, single jersey basis weight, for example.

The benefits of the presently disclosed and claimed invention are evident when the prior art process shown diagrammatically in FIG. 4, is compared with the inventive process shown diagrammatically in FIGS. 5 and 6. Traditional knitting and finishing require additional process steps, additional equipment, and significantly increased labor-intensive operations than does either alternative method of the invention shown in FIGS. 5 and 6. Further, by eliminating high-temperature heat set previously required (see FIG. 4), the inventive process reduces heat damage to fibers like cotton, requires less or no bleaching, and thus improves the 'hand' of the finished fabric. As a further benefit, heat sensitive hard yarns can be used in the invention process to make circular knit, elastic fabrics of at least one of single jersey, French terry and fleece, thus increasing the possibilities for different and improved products.

The use of a softener is optional, but commonly a softener will be applied to the knit fabric to further improve fabric hand, and to increase mobility of the knit stitches during drying. Softeners such as SURESOFT or SANDOPERM SEI are typical. The circular knit, elastic fabric may be passed through a trough containing a liquid softener composition, and then through the nip between a pair a pressure rollers (padding rollers) to squeeze excess liquid from such fabric.

Another unexpected advantage of the present invention is that the circular knit, elastic fabrics of at least one of single jersey, French terry, and fleece knitted by the method of the invention and collected by folding (plaiting), do not crease to the same extent as prior art circular knit single jersey fabrics. Fewer or less visible fold creases in the finished fabric result in an increased yield for cutting and sewing the fabric into garments. Also unexpectedly, the circular knit, elastic fabrics of at least one of single jersey, French terry, and fleece of the invention have significantly reduced "skew". The decrease in skew is accomplished through either open-width or tubular finishing processes. If a fabric has increased skew or spirality, the fabric is diagonally deformed and knitted courses are "on the bias". Garments made with skewed fabric will twist on the body and are unacceptable for use.

The following examples demonstrate the presently disclosed and claimed invention and its benefits. The invention is capable of other and different embodiments, and its several details are capable of modifications in various apparent respects, without departing from the scope and spirit of the presently disclosed and claimed invention. Accordingly, the examples are to be regarded as illustrative in nature and not as restrictive.

EXAMPLES

Fabric Knitting and Finishing

Circular knit, elastic fabrics of at least one of single jersey, French terry, and fleece with bare spandex plated with hard yarn for the examples were knit on either: (1) Pai Lung Circular Knitting Machine Model PL-FS3B/T, with 16 inch cylinder diameter, 28 gauge cylinder (needles per circumferential inch), and 48 yarn feed positions; (2) Pai Lung Circular Knitting Machine Model PL-XS3B/C, with 26 inch cylinder diameter, 24 gauge cylinder, and 78 yarn feed positions; or (3) Monarch Circular Knitting Machine Model VXC-3S, with 30 inch cylinder diameter, 20 gauge cylinder, and 90 yarn feed positions. The 28 and 20-gauge machines were operated at 24 revolutions per minute (rpm), and the 24-gauge machine at 26 rpm.

The broken end detector in each spandex feed path (see FIG. 2) was either adjusted to reduce sensitivity to yarn tension, or removed from the machines for these examples. The broken end detector was a type that contacted the yarn, and therefore induced tension in the spandex.

The spandex feed tension was measured between the spandex supply package 36 and the roller guide 37 (FIG. 2) with a Zivy digital tension meter, model number, EN-10. The spandex feed tensions were maintained at 1 gram or less for 20 and 30-denier spandex. These tensions were sufficiently high for reliable and continuous feeding of the spandex yarn to the knitting needles, and sufficiently low to draft the spandex only about 2.5× or less. It was determined that when the feed tensions were too low, the spandex yarn wrapped around the roller guides at the supply package and could not be reliably fed to the circular knitting machine.

All the knitted fabrics were scoured, dyed and dried per the open-width process 61*a* or tubular process 61*b* of FIG. 5 or tubular process 81*b* or FIG. 6. With the exception of Examples 1A, 11A, 22, 24, 46, and 56-59 all knitted fabrics were finished in the same way, and without heat setting. The fabric of Examples 1A and 11A were also stretched and heat set at 190° C. for a residence time of 60 seconds. The fabrics of Examples 22, 24 and 46 were finished per the tubular process 61*b* of FIG. 5. The fabrics of Examples 56-59 were finished per the tubular process of 81*b* of FIG. 6.

Examples 1-19, 28-31 and 33-47 were dyed and finished according to the following procedure. Fabrics were scoured and bleached in a 300-liter solution at 100° C. for 30 minutes. All such wet, jet finishing, including dyeing, was done in a Tong Geng machine (Taiwan) Model TGRU-HAF-30. The water solution contained Stabilizer SIFA (Clariant, 300 g) (silicate free alkaline), NaOH (45%, 1200 g), $H_2O_2$ (35%, 1800 g), IMEROL ST (Clariant, 600 g) for cleaning, ANTIMUSSOL HT2S (Clariant, 150 g) for antifoaming, and IMACOL S (Clariant, 150 g) for anti-creasing. After 30 minutes, the solution and fabric were cooled to 75° C. and then the solution was drained. The fabric was subsequently neutralized in a 300 liter solution of water and HAC (150 g) (hydrogen+dona, acetic acid) at 60° C. for 10 minutes. The fabrics were dyed in a 300-liter solution of water at 60° C. for 60 minutes, using reactive dyestuffs and other constituents. The dye solution contained R-3BF (215 g), Y-3RF (129 g), $Na_2SO_4$ (18,000 g), and $Na_2CO_3$ (3000 g). After 10 minutes, the dyebath was drained and refilled to neutralize with HAC (150 g) for 10 minutes at 60° C. After neutralization, the bath was again drained and refilled with clean water for a 10-minute rinse. Subsequent to neutralization, the 300-liter vessel was again filled with water, and 150 g of SANDOPUR RSK (Clariant, soap) was added. The solution was heated to 98° C., and the fabrics were washed/soaped for 10 minutes. After draining and another 10 minute clean-water rinse, the fabrics were unloaded from the vessel. The wet fabrics were then de-watered by centrifuge, for 8 minutes. For the final step, a lubricant (softener) was padded onto the fabrics in a 77-liter water solution with SANDOPERM SEI liquid (Clariant, 1155 g). The fabrics were then dried in a tenter oven at 145° C. for about 30 seconds, at 50% overfeed. The above procedure and additives will be familiar to those experienced in the art of textile manufacturing, and circular knitting of single jersey knit fabrics.

Examples 20 and 32 were finished according to the following procedure. Fabric was scoured and bleached in a 375-liter solution at 100° C. for 30 minutes. All such wet, jet finishing, including dyeing, was done in a Tong Geng machine (Taiwan) Model TGRU-HAF-30. The water solution contained Stabilizer SIFA (375 g) (silicate free alkaline), NaOH (45%, 1500 g), $H_2O_2$ (35%, 22509), HUMECTOL (Clariant, 281 g) for cleaning, ANTIMUSSOL HT2S (112.5 g) for antifoaming, and IMACOL S (187.5 g) for anti-creasing. After 30 minutes, the solution and fabric were cooled to 75° C. and then the solution was drained. The fabric was subsequently neutralized in a 300 liter solution of water and HAC (187.5 g) (hydrogen+dona, acetic acid) at 60° C. for 10 minutes. The fabrics were dyed in a 375-liter solution of water at 60° C. for 60 minutes, using reactive dyestuffs and other constituents. The dye solution contained R-3BF (89 g), Y-3RF (89 g), NAVY BLUE HFGG(594 g) $Na_2SO_4$ (22,500 g), and $Na_2CO_3$ (3750 g). After 10 minutes, the dyebath was drained and refilled to neutralize with HAC (187.5 g) for 10 minutes at 60° C. After neutralization, the bath was again drained and refilled with clean water for a 10-minute rinse. Subsequent to neutralization, the 375-liter vessel was again filled with water, and 187.5 g of SANDOPUR RSK (soap) was added. The solution was heated to 98° C., and the fabrics were washed/soaped for 10 minutes. After draining and another 10 minute clean-water rinse, the fabrics were unloaded from the vessel. The wet fabric was then de-watered by centrifuge, for 8 minutes. For the final step, a lubricant (softener) was padded onto the fabric in a 77-liter water solution with ABLUSOFT SN201 liquid (1600 g) (TAIWAN SURFACTANT). The fabric was then dried in a tenter oven at 145° C. for about 30 seconds, at 50% overfeed.

Example 21 was finished according to the following procedure. Fabric was scoured in a 300-liter solution at 90° C. for 20 minutes. All such wet, jet finishing, including dyeing, was done in a Tong Geng machine (Taiwan) Model TGRU-HAF-30. The solution contained Humectol LYS (225 g) for cleaning, ANTIMUSSOL HT2S (90 g) for antifoaming, IMACOL S (150 g) for anti-creasing and Soda ash (600 g). After 20 minutes, the solution and fabric were cooled to 75° C. and then the solution was drained. The fabric was subsequently neutralized in a 300 liter solution of water and HAC (150 g) (hydrogen+dona, acetic acid) at 60° C. for 10 minutes. The fabrics were dyed in a 300-liter solution of water at 130° C. for 30 minutes, using disperse dyestuffs and other constituents. The dye solution contained disperse dyes, Imacol S(150 g), Antimussol HT2S (90), Sandogen EDP (Clariant, 300 g) and HAC for PH. After dyeing, Cool down dyebath to 75 C, then drain and refill with clean water for a 10-minute rinse. Drain, then refill fresh water for Reduction Cleaning for 85 C×30'. The cleaning solution contained 1. $Na_2CO_3$ (600 g), 2. NaOH 45% (1,050 g) 3. $Na_2SO_4$ (1,800 g). Cool to 75 C, then overflow and drain. Then refill fresh water with HAC (150 g) for neutralization for 10 minutes. Then drain and unload fabric. The wet fabrics were then de-watered by-centrifuge, for 8 minutes. For the final step, The fabric was then dried in a tenter oven at 145° C. for about 30 seconds, at 50% overfeed.

Examples 22 through 26 were dyed and finished according to the following procedure. Fabrics were scoured similarly to Example 21, see above. The fabrics were dyed in a 300-liter solution of water at 98 for 30 minutes, using acid dyestuffs and other constituents. The dye solution contained acid dyes Brilliant Blue-CFBA 1.0% OWF from Clariant, Imacol S(150 g), Antimussol HT2S (150 g), Sandogen NH (225 g) and Sandacid Vs or HAC (300 g) for PH 4.5-5.0. After dyeing, cool down dyebath to 75° C., then drain and refill with clean water for a 10-minute rinse. Drain, then refill fresh water for color fixing for 70 C×20'. The solution contained 1. Hac (60 g), 2. Nylofixan P (Clariant, 600 g). Then overflow and drain. Again refill fresh water for another 10 minutes rinse and drain. Then unload fabric. The wet fabrics were then de-watered by centrifuge, for 8 minutes. For the final step, The fabrics were then dried in a tenter oven at 145° C. for about 30 seconds, at 50% overfeed.

Example 27 was dyed and finished according to the following procedure. Fabrics were scoured in a 300-liter solution at 90° C. for 20 minute and done in a Tong Geng machine (Taiwan) Model TGRU-HAF-30. The solution contained Humectol LYS (225 g) for cleaning, ANTIMUSSOL HT2S (90 g) for antifoaming, and IMACOL S (150 g) for anti-creasing. After 20 minutes, the solution and fabric were cooled to 75° C., then the solution was drained. Refill water for another rinse for 10 minutes in a 300 liter solution. The wet fabrics were then de-watered by centrifuge, for 8 minutes. For the final step, The fabrics were then dried in a tenter oven at 130° C. for about 30 seconds, at 50% overfeed.

Examples 48-55 were scoured, dyed and dried per the process 51*a* in FIG. 5. Fabrics were scoured in a jet dye machine (Tong Geng Enterprise Co. Ltd. TGRU-HAF-1-30) at 90° C. for 20 minutes. The concentration of ingredients in the scouring solution, per liter of water, were as follows: 0.75 g/l Humectol Lys (Clariant), 2.0 g/l $Na_2CO_3$ (Sesoda), 0.5 g/l Imacol S (Clariant), 0.5 g/l Antimussol HT2S (Clariant), and 0.5 g/l Glacial acetic acid.

The fabrics were dyed individually, and the same machine was used for each example. For examples 48 and 52, Brilliant Red-SR GL (Clariant), a middle energy dye type SE (or C), was used at a 3.5% level based on the weight of fabric (OWF). For examples 49 and 53, Rubine SWF (Clariant) at 3.0% OWF and Black SWF (Clariant) at 1.5% OWF were used. Both these are middle energy dyes, type SE (or C). For examples 50 and 54, Dark Blue RD2RE 300% (Clariant), a high energy dye type S (or D), was used at 3.5% OWF. For examples, 51 and 55, Black RD-3GE 300% (Clariant), a high energy dye type S (or D), was used at 3.57% OWF. The liquor ratio was 1:12. The concentrations of ingredients in the dye liquor for each fabric, per liter of water, were as follows: dye as given above, 0.5 g/l Imacol S (Clariant), and 2.0 g/l Sandacid PB (Clariant). The dyebath pH was 4.12. The fabric cycle time was 51 seconds/cycle. The bath temperature was raised from room Temperature to 130 ° C. at the rate of 1° C. per minute. The process was operated at 130° C. for 30 minutes, followed by cool down to 70° C. at the cool down rate of 1° C. per minute. The dyebath was then drained and the machine recharged with cool water, followed by rinsing of the fabric for 10 minutes. The water was subsequently drained to prepare the fabric for reduction clearing.

The fabric was subsequently reduction cleared in the jet dye machine in a clearing solution at 85° C. for 30 minutes. The ingredients in the solution, per liter of water, were as follows: 3.0 g/l Eriopon OS (Ciba), 2.0 g/l $Na_2Co_3$ (Sesoda), 3.33 ml/l NaOH (45%), 0.5 g/l Antimussol HT2S (Clariant), and 6.0 g/l $NaS_2O_4$. The solution temperature was raised from room temperature to 85° C. at a rate of 1° C. per minute and held there for 30 minutes. The solution was subsequently cooled down to 60° C. at the rate of 1° C. per minute, and then drained. Following that, the fabric was neutralized with glacial acetic acid for 10 minutes, then rinsed with clean water for 5 minutes. The wet fabrics were then de-watered by centrifuge, for 8 minutes or until water is removed depending on fabric and diameter and speed of equipment, as per normal practice. For the final step, a lubricant (softener) was padded onto the fabrics in a 77-liter water solution with Sandoperm SEI (Clariant, 1155 g). The fabrics were then dried in a tenter oven at about 130° C. for about 30 seconds, at about 50% fabric overfeed.

Examples 56-59 were bleached in a jet dye machine (TurboJet®, Textile Sales International, Concord, N.C.) at 113° C.

for thirty minutes. The concentration of ingredients in the bleaching solution, based on fabric weight, were as follows: 8% owf hydrogen peroxide, 1% owf Stabilon EZY® (CIBA Specialty Chemicals, High Point, N.C.), and acetic acid to neutralize. The liquor ratio was 1:8. The bath temperature was raised from 82° C. to 113° C. at the rate of 3° C. per minute. The process was operated at 113° C. for 30 minutes, followed by cool down to 77° C. at the cool down rate of 6° C. per minute. The dyebath was then drained and the machine recharged with 77° C water heated to 82° C., run for 10 minutes, cooled down to 77° C., and drained. The batch was charged once again with 49° C. water, heated to 77° C., run for 10 minutes, and drained. Fabric was subsequently neutralized with acetic acid at 60° C. for 5 minutes, followed by dewatering. The wet fabrics were then de-watered by squeeze rollers, as per normal practice. For Examples 57 and 59, the fabrics were relax dried at 143° C. with maximum overfeed using a belt relax dryer (Tubetex, Tubular Textile Group, Lexington, N.C.). The fabrics were turned inside out and compacted with steam and 4% overfeed at 149° C. (Tubetex, Tubular Textile Group, Lexington, N.C.). For Examples 56 and 58, the fabrics were padded with a nap assist (American Textiles Specialties, Spartanburg, S.C.) were relax dried at 143° C. with maximum overfeed using a belt relax dryer (Tubetex, Tubular Textile Group, Lexington, N.C.). The fabrics were napped using a Gessner Lynx double action tandem napper (The Gessner Company, Chariton, Mass.) for a total of four times on one side. For the final step, The fabrics were compacted with steam at 4% overfeed at 149° C. (Tubetex, Tubular Textile Group, Lexington, N.C.).

The above procedure and additives will be familiar to those experienced in the art of textile manufacturing and circular knitting of single jersey knit fabrics.

Analytical Methods

Spandex Draft—The following procedure, conducted in an environment at 20° C. and 65% relative humidity, is used to measure the spandex drafts in the Examples.

- De-knit (unravel) a yarn sample of 200 stitches (needles) from a single course, and separate the spandex and hard yarns of this sample. A longer sample is de-knit, but the 200 stitches are marked at beginning and end.
- Hang each sample (spandex or hard yarn) freely by attaching one end onto a meter stick with one marking at the top of the stick. Attach a weight to each sample (0.1 g/denier for hard yarn, 0.001 g/denier for spandex). Lower the weight slowly, allowing the weight to be applied to the end of the yarn sample without impact.
- Record the length measured between the marks. Repeat the measurements for 5 samples each of spandex and hard yarn.
- Calculate the average spandex draft according to the following formula:

Draft=(Length of hard yarn between marks)÷(Length of spandex yarn between marks).

If the fabric has been heat set, as in the prior art, it is usually not possible to measure the in-fabric spandex draft. This is because the high temperatures needed for spandex heat setting will soften the spandex yarn surface and the bare spandex will tack to itself at stitch crossover points 16 in the fabric (FIG. 1). Because of such multiple tack points, one cannot de-knit fabric courses and extract yarn samples.

Fabric Weight—Knit Fabric samples are die-punched with a 10 cm diameter die. Each cut-out knit fabric sample is weighed in grams. The "fabric weight" is then calculated as grams/square meters.

Spandex Fiber Content—Knit fabrics are de-knit manually. The spandex is separated from the companion hard yarn and weighed with a precision laboratory balance or torsion balance. The spandex content is expressed as the percentage of spandex weight to fabric weight.

Fabric Elongation—The elongation is measured in the warp direction only. Three fabric specimens are used to ensure consistency of results. Fabric specimens of known length are mounted onto a static extension tester, and weights representing loads of 4 Newtons per centimeter of length are attached to the specimens. The specimens are exercised by hand for three cycles and then allowed to hang free. The extended lengths of the weighted specimens are then recorded, and the fabric elongation is calculated.

Shrinkage—Two specimens, each of 60×60 centimeters, are taken from the knit fabric. Three size marks are drawn near each edge of the fabric square, and the distances between the marks are noted. The specimens are then sequentially machine washed 3 times in a 12-minute washing machine cycle at 40° C. water temperature and air dried on a table in a laboratory environment. The distances between the size marks are then remeasured to calculate the amount of shrinkage.

Face Curl—A 4-inch×4-inch (10.16 cm×10.16 cm) square specimen is cut from the knit fabric. A dot is placed in the center of the square, and an 'X' is drawn with the dot as the center of the 'X'. The legs of the 'X' are 2 (5.08 cm) inches long and in line with the outside corners; of the square. The X is carefully cut with a knife, and then the fabric face curls of two of the internal points created by the cut are measured immediately and again in two minutes, and averaged. If the fabric points curl completely in a 360° circle, the curl is rated as 1.0; if it curls only 180°, the curl is rated ½; and so on. Curl values of ¾ or less are acceptable.

Differential Scanning Calorimetry—This procedure induces (4) temperatures into the same specimen of spandex without removing the sample from the differential scanning calorimeter (DSC). The DSC instrument is a Perkin Elmer Differential Scanning Calorimeter Model Pyris 1, commercially available from Perkin Elmer (45 William Street, Wellesley, Mass. 02481-4078, USA, Telephone 781-237-5100). The instrument is programmed to start at 50° C. and heat to 140, 160, 180, and 200° C. with a 1 minute hold at each temperature. The sample is cooled to the starting temperature of 50° C. after each endotherm is scanned, then held at 50° C. for 5 minutes prior to scanning the next higher temperature.

The specimen is then scanned from 50° C. to 240° C. to locate the endotherms that are induced in the prior test. Each endotherm is found ±3° C. The variance in the endotherms found vs. the temperature induced is within tolerance of the DSC instrument.

Molecular weight analysis—The molecular weight of a spandex fiber can be determined via the following method. An Agilent Technologies 1090 LC (liquid chromatograph, Agilent Technologies, Palo Alto, Calif.) equipped with a UV detector fitted with a 280 nanometer filter in a filter photometric detector and 2 Phenogel™ columns (300 mm×7.8 mm packed with 5 micron column packing of styrene and divinyl benzene in a linear/mixed bed (Phenomex®, Torrance, Calif.), was used to analyze the molecular weight of spandex polymers. Samples were run in mobile phase at a flow rate of 1 ml/min and at a column temperature of 60° C. The sample for analysis is prepared in using 2.0-3.0 milligrams of polymer per milliliter of solvent. A 50 microliter sample of polymer solution was injected into the LC for analysis. The resulting chromatographic data was analyzed using Viscotek 250 GPC software (Viscotek, Houston, Tex.).

The LC was calibrated using a Hamielec Broad standard calibration method and a broad standard of polyurethane/urea polymer of stable molecular weight, containing no finish, additives, or pigments. The broad standard was fully characterized for weight average molecular weight (104,000 daltons) and number average molecular weight (33,000 daltons) before use as a standard.

Chlorine Degradation Test-for Fabric—Xrel—To measure the resistance of fabric to chlorine induced degradation, a test was run which simulates the environment in a swimming pool. A fabric loop was cycled in a bath containing 3.5 ppm chlorine and 1.5 ppm urea, at pH 7.6 and a temperature of 25° C. while submerged in the simulated swimming pool solution. The fabric sample dimensions are 22 cm×5 cm, with a sewing seam line marked at 1 cm on both ends of the long axis. The final sewn dimensions are a 10 cm loop×5 cm wide. The sewn sample loops are mounted onto rod shaped sample holders and cycled in the lengthwise direction from 0 to 40% elongation. The power of the fabric is measured every 20 minutes for a total of 120 continuous hours. The comparison fabric is a warp knit tricot fabric containing 21% Lycra® spandex, which is state of the art in terms of high durability in a simulated chlorinated swimming pool environment (54 den, 60 decitex Lycra® spandex T275B and 40 den, 44 decitex textured nylon-66). The reference fabric is a black dyed tricot warp knit (lock knit) made from 40 den (44 decitex) nylon 66 and 40 den (44 decitex) Lycra® spandex T162C. The fabric content is 83% nylon and 17% Lycra® spandex. Xrel is the ratio of the number of hours for the test item to reach 40% of its original power (where 100% is defined as the fabric power in centi-newtons after the test has been running for 3 hours), divided by the number of hours for the reference fabric to reach 40% of its original power.

EXAMPLES

Table 1 below sets forth the knitting conditions for the example knit fabrics. Lycra® types 162, 169, or 562 were used for the spandex feeds. Lycra® deniers were 70, 55, 40, 30, 20, and 15, or 78 dtex, 61 dtex, 44 dtex, 33 dtex, 22 dtex, and 17 dtex, respectively. The stitch length, L, was a machine setting. Table 2 below summarizes key results of the tests for finished fabrics. Table 3 summarizes data on chlorine degradation for Example 38. Values of curl were acceptable for all test conditions, and will not be further discussed below. Spandex feed tensions are listed in grams 1.00 gram equals 0.98 centiNewtons(cN).

TABLE 1

KNITTING CONDITIONS

| Example | Lycra® Type | Lycra® Decitex | Yarn Type | Yarn count | Stitch Length, L in mm | Cover Factor, Cf | Machine Gauge, needles/inch |
|---|---|---|---|---|---|---|---|
| 1 | T169 | 44 | Cotton | 32 Ne | 3.06 | 1.4 | 28 |
| 1A | T169 | 44 | Cotton | 32 Ne | 3.06 | 1.4 | 28 |
| 2 | T169 | 22 | Cotton | 32 Ne | 3.06 | 1.4 | 28 |
| 3 | T169 | 22 | Cotton | 32 Ne | 3.06 | 1.4 | 28 |
| 4 | T169 | 22 | Cotton | 32 Ne | 2.3 | 1.87 | 28 |
| 5 | T169 | 22 | Cotton | 32 Ne | 3.57 | 1.2 | 28 |
| 6 | T169 | 22 | Cotton | 40 Ne | 3.06 | 1.25 | 28 |
| 7 | T169 | 22 | Cotton | 32 Ne | 3.06 | 1.4 | 28 |
| 8 | T169 | 33 | Cotton | 40 Ne | 2.75 | 1.4 | 28 |
| 9 | T169 | 22 | Cotton-Polyester | 32 Ne | 3.06 | 1.4 | 28 |
| 10 | T562 | 22 | Cotton | 32 Ne | 3.06 | 1.4 | 28 |
| 11 | T169B | 44 | Cotton | 32 Ne | 3.1 | 1.4 | 28 |
| 11A | T169B | 44 | Cotton | 32 Ne | 3.1 | 1.4 | 28 |
| 12 | T169B | 33 | Cotton | 20 Ne | 4.0 | 1.4 | 28 |
| 13 | T169B | 33 | Cotton | 20 Ne | 4.0 | 1.4 | 28 |
| 14 | T562B | 78 | Cotton | 26 Ne | 3.4 | 1.4 | 28 |
| 15 | T562B | 78 | Cotton | 32 Ne | 3.1 | 1.4 | 28 |
| 16 | T562B | 78 | Cotton | 20 Ne | 3.9 | 1.4 | 28 |
| 17 | T562B | 44 | Cotton | 32 Ne | 3.1 | 1.4 | 28 |
| 18 | T162C | 22 | Cotton | 26 Ne | 3.0 | 1.6 | 28 |
| 19 | T162C | 22 | Cotton | 26 Ne | 3.0 | 1.6 | 28 |
| 20 | T162C | 78 | Cotton | 20 Ne | 4.5 | 1.2 | 28 |
| 21 | T162C | 22 | Spun Polyester | 40 Ne | 2.9 | 1.3 | 28 |
| 22 | T169B | 22 | Textured Nylon | 156 dtex | 3.1 | 1.3 | 28 |
| 23 | T169B | 22 | Textured Nylon | 156 dtex | 3.1 | 1.3 | 28 |
| 24 | T562B | 22 | Textured Nylon | 156 dtex | 3.1 | 1.3 | 28 |
| 25 | T562B | 22 | Textured Nylon | 156 dtex | 3.1 | 1.3 | 28 |
| 26 | T162C | 61 | Polypropylene | 116 dtex | 2.9 | 1.14 | 28 |
| 27 | T162C | 61 | Polypropylene | 116 dtex | 2.9 | 1.14 | 24 |
| 28 | T169B | 22 | Cotton | 32 Ne | 3.06 | 1.4 | 28 |
| 29 | T169B | 22 | Cotton | 32 Ne | 3.06 | 1.4 | 28 |
| 30 | T562B | 22 | Cotton | 32 Ne | 3.06 | 1.4 | 28 |
| 31 | T562B | 22 | Cotton | 26 Ne | 3.43 | 1.4 | 28 |
| 32 | T169B | 22 | Cotton | 32 Ne | 3.55 | 1.2 | 28 |
| 33 | T165C | 17 | Polypropylene | 55 dtex | 2.25 | 1.05 | 28 |
| 34 | T165C | 17 | Polypropylene | 55 dtex | 2.25 | 1.05 | 28 |
| 35 | T169B | 33 | Polypropylene | 55 dtex | 2.25 | 1.05 | 28 |
| 36 | T169B | 33 | Polypropylene | 110 dtex | 2.91 | 1.14 | 24 |
| 37 | T169B | 33 | Polypropylene | 110 dtex | 2.25 | 1.14 | 24 |
| 38 | T162B | 44 | Polypropylene | 110 dtex | 2.91 | 1.14 | 24 |
| 39 | T162C | 78 | Polypropylene | 165 dtex | 4.17 | 1.2 | 24 |

TABLE 1-continued

KNITTING CONDITIONS

| Example | Lycra® Type | Lycra® Decitex | Yarn Type | Yarn count | Stitch Length, L in mm | Cover Factor, Cf | Machine Gauge, needles/inch |
|---|---|---|---|---|---|---|---|
| 40 | T169B | 22 | Polypropylene/ Cotton | 55 dtex, 40 Ne | 3.2 | 1.55 | 24 |
| 41 | T169B | 33 | Polypropylene | 55 dtex | 2.25 | 1.05 | 28 |
| 42 | T169B | 33 | Polypropylene | 110 dtex | 2.91 | 1.14 | 24 |
| 43 | T169B | 33 | Polypropylene | 110 dtex | 2.91 | 1.14 | 24 |
| 44 | T162B | 44 | Polypropylene | 110 dtex | 2.91 | 1.14 | 24 |
| 45 | T162C | 78 | Polypropylene | 165 dtex | 4.17 | 1.2 | 24 |
| 46 | T162B | 44 | Polypropylene | 110 dtex | 2.91 | 1.14 | 24 |
| 47 | T162B | 44 | Polypropylene | 110 dtex | 2.91 | 1.14 | 24 |
| 48 | T169B | 33 | Polyester | 165 dtex | 2.92 | 1.4 | 24 |
| 49 | T169B | 33 | Polyester | 165 dtex | 2.92 | 1.4 | 24 |
| 50 | T169B | 33 | Polyester | 165 dtex | 2.92 | 1.4 | 24 |
| 51 | T169B | 33 | Polyester | 165 dtex | 2.92 | 1.4 | 24 |
| 52 | T162C | 44 | Polyester | 165 dtex | 2.92 | 1.4 | 24 |
| 53 | T162C | 44 | Polyester | 165 dtex | 2.92 | 1.4 | 24 |
| 54 | T162C | 44 | Polyester | 165 dtex | 2.92 | 1.4 | 24 |
| 55 | T162C | 44 | Polyester | 165 dtex | 2.92 | 1.4 | 24 |
| 56 | T562B | 33 | Cotton (2 ends) | 30 & 20 Ne | 3.07 | 1.5 | 20 |
| 57 | T562B | 33 | Cotton (2 ends) | 30 & 20 Ne | 3.07 | 1.5 | 20 |
| 58 | T562B | 22 | Cotton (2 ends) | 30 & 20 Ne | 3.07 | 1.5 | 20 |
| 59 | T562B | 22 | Cotton (2 ends) | 30 & 20 Ne | 3.07 | 1.5 | 20 |

TABLE 2

RESULTS

| Example | Lycra® Draft | Basis Weight, $g/m^2$ | Maixmum Length Elongation, % | Lycra® Content, % weight | Shrinkage %, Warp by Weft | Face Curl, Fraction of 360° |
|---|---|---|---|---|---|---|
| 1 | 2.7 | 306 | 169 | 8 | 7.4 × 5.7 | ¼ |
| 1A | 2.7 | 204 | 115 | 8 | 5.1 × 0.8 | ¼ |
| 2 | 2 | 218 | 105 | 6 | 3.3 × 4.2 | ¼ |
| 3 | 1.8 | 206 | 88 | 6 | 2.6 × 4.2 | ¼ |
| 4 | 1.9 | 229 | 65 | 6 | 2.9 × 3.8 | ¼ |
| 5 | 2.2 | 204 | 114 | 5 | 16.1 × 0.7 | ¼ |
| 6 | 2 | 178 | 98 | 7 | 12.4 × 2.7 | ¼ |
| 7 | 1.9 | 208 | 104 | 6 | 4.0 × 4.3 | ¼ |
| 8 | 1.7 | 178 | 89 | 12 | 5.6 × 4.4 | ¾ |
| 9 | 2 | 229 | 112 | 6 | 2.4 × 1.3 | ¼ |
| 10 | 1.9 | 207 | 96 | 6 | 3.3 × 3.7 | ¼ |
| 11 | 2.7 | 306 | 169 | 8 | −7 × −6 | ¼ |
| 11A | 2.7 | 204 | 115 | 8 | −5 × −1 | ¼ |
| 12 | 2.2 | 266 | 83 | 5 | −9 × 0 | ¾ |
| 13 | 1.8 | 244 | 75 | 6 | −6 × −2 | ¾ |
| 14 | 2.0 | 300 | 89 | 14 | −3 × −2 | ⅜ |
| 15 | 1.8 | 262 | 90 | 19 | −1 × −2 | ½ |
| 16 | 1.7 | 292 | 74 | 13 | −3 × −3 | ⅜ |
| 17 | 1.8 | 247 | 107 | 12 | −2 × −3 | ½ |
| 18 | 2.1 | 239 | 62 | 4 | −3 × −2 | ½ |
| 19 | 2.5 | 249 | 82 | 4 | −5 × −4 | ¼ |
| 20 | 1.96 | 215 | 124 | 6 | −7 × 3 | ¾ |
| 21 | 1.9 | 247 | 87 | 7 | −2 × 0 | ¼ |
| 22 | 2.0 | 254 | 97 | 7 | −2 × 0 | ⅛ |
| 23 | 2.0 | 242 | 97 | 7 | −3 × −2 | ⅛ |
| 24 | 2.0 | 248 | 104 | 7 | −3 × −2 | 0 |
| 25 | 2.0 | 260 | 103 | 7 | −2 × 0 | ⅛ |
| 26 | 2.5 | 302 | 173 | 18 | 0 × −5 | ½ |
| 27 | 2.0 | 268 | 160 | 27 | 0 × −2 | ⅞ |
| 28 | 2.0 | 177 | 67 | 6 | −8 × −4 | 1.0 |
| 29 | 2.0 | 184 | 78 | 6 | −4 × −1 | ¾ |
| 30 | 1.8 | 195 | 87 | 6 | −4 × −3 | ¾ |
| 31 | 2.0 | 229 | 76 | 4 | −12 × 2 | ⅜ |
| 32 | 2.0 | 215 | 124 | 6 | −7 × 2 | ¾ |
| 33 | 2.0 | 169 | 140 | 14 | −1 × −1 | ¼ |
| 34 | 2.5 | 213 | 198 | 11 | −1 × −1 | ⅛ |
| 35 | 2.0 | 207 | 145 | 25 | −1 × 0 | ½ |
| 36 | 2.3 | 250 | 202 | 12 | 0 × −2 | ⅜ |
| 37 | 2.0 | 220 | 86 | 13 | 0 × −1 | ¼ |
| 38 | 2.0 | 252 | 189 | 17 | −1 × −1 | ⅜ |

TABLE 2-continued

RESULTS

| Example | Lycra® Draft | Basis Weight, g/m$^2$ | Maixmum Length Elongation, % | Lycra® Content, % weight | Shrinkage %, Warp by Weft | Face Curl, Fraction of 360° |
|---|---|---|---|---|---|---|
| 39 | 2.5 | 343 | 142 | 16 | 0 × −1 | ⅜ |
| 40 | 2.0 | 245 | 94 | 6 | −2 × −3 | ⅜ |
| 41 | 2.5 | 235 | 208 | 20 | −1 × 0 | ½ |
| 42 | 2.0 | 221 | 169 | 13 | −2 × −3 | ⅛ |
| 43 | 2.5 | 274 | 239 | 10 | −1 × −1 | ½ |
| 44 | 2.5 | 286 | 235 | 14 | 0 × −1 | ⅜ |
| 45 | 2.0 | 320 | 108 | 19 | 0 × −1 | ½ |
| 46 | 2.0 | 248 | 159 | 18 | −3 × 0 | ½ |
| 47 | 2.0 | 251 | 150 | 18 | −2 × −2 | ¼ |
| 48 | 2.5 | 298 | 104 | 7 | −1 × −1 | 0 |
| 49 | 2.5 | 297 | 101 | 7 | −2 × −1 | 0 |
| 50 | 2.5 | 300 | 103 | 7 | −1 × −1 | 0 |
| 51 | 2.5 | 298 | 100 | 7 | −2 × −1 | 0 |
| 52 | 2.5 | 306 | 106 | 9 | 0 × 0 | 0 |
| 53 | 2.5 | 305 | 104 | 9 | 0 × −1 | 0 |
| 54 | 2.5 | 305 | 105 | 9 | 0 × −1 | 0 |
| 55 | 2.5 | 309 | 104 | 9 | 0 × −1 | 0 |
| 56 | 1.9 | 272 | 59 | 3.5 | −13 × −6 | 0 |
| 57 | 1.9 | 284 | 65 | 3.5 | −7 × −6 | 0 |
| 58 | 1.9 | 243 | 48 | 5 | −15 × −5 | 0 |
| 59 | 1.9 | 261 | 60 | 5 | −7 × −6 | 0 |

TABLE 3

Pool Test

| ITEM | Xrel, hours |
|---|---|
| Reference Fabric | 6.84 |
| Example 38 | >7.06 |

Examples 1-10

Example 1

The 40-denier spandex feed tension was 5 grams (4.9 cN), which is in the range of 4 to 6 cN recommended in the prior art. Because of the compressive forces of the spandex, the as-knit fabric basis weight was high (266 g/m$^2$), and higher still in the finished fabric (306 g/m$^2$). Shrinkage also exceeded 7% in the length direction.

Example 1A

The knit fabric of Example 1 was stretched and heat set at 190° C. for 60 seconds. The as-knit weight and elongation properties were the same as or Example 1, but heat setting reduced the finished fabric to 204 g/m$^2$ and 115% elongation. Spandex draft and content could not be measured by the analytical methods above, as the heat-set fabric could not be de-knitted because the bare spandex tacked together due to the heat-setting step. The spandex content, however, was the same as for Example 1.

Example 2

Parameters were set at typical values. Cotton count was 54 Nm, the cover factor was 1.4, the spandex denier was 20, and the spandex draft was 2.0. The spandex was Lycra® Type 169. The knit fabric was not heat set.

Example 3

The 20-denier spandex feed tension was lowered to 0.8 grams (0.78 cN). For the Pai Lung knitting machine and spandex yarn path, this was a minimum value for feed tension to maintain continuity of spandex takeoff from the supply package. The knit fabric was not heat set.

Example 4

The stitch length was reduced to 2.3 mm so that the cover factor was 1.87, near the upper limit of the invention. The knit fabric was not heat set.

Example 5

The stitch length was increased to 3.57 mm in order to reduce the cover factor to a value of 1.2. This value is below the limits of the invention (lower limit—1.3). The knit fabric was not heat set. The spandex draft was slightly above 2.2, probably because of interactions of spandex drafting by knitting needle friction at longer stitch lengths.

Example 6

Cotton spun yarn count was increased from 54 to 68 Nm for this example. Stitch length was maintained at 3.06 mm, so that the cover factor was reduced to 1.25 by this change in spun yarn count. The knit fabric was not heat set.

Example 7

Knitting machine model PL-XS3B/C, with a gauge of 24 needles per circumferential inch, was used to knit the fabric of this example. All knitting and fabric design variables were within the invention. The knit fabric was not heat set.

Example 8

The spandex denier was increased to 30 denier, and the cotton count was increased to 68 Nm (denier reduced), so that the % spandex content in the fabric increased to 12.1%. Stitch length was reduced to maintain the cover factor at 1.4. The knit fabric was not heat set.

Example 9

Two hard yarns were plated, together with the spandex, into the knit stitches. The first hard yarn was spun cotton with count 60 Ne, or 101.6 Nm. The second hard yarn was continuous filament polyester yarn of 83 dtex and 34 filaments. These were plated together with 22 dtex (20 denier) spandex. The combined hard yarn count was 55 Nm. The knit fabric was not heat set.

Example 10

Process parameters were the same as in Example 2, except that a different spandex yarn, Lycra* Type 562 ('easy-set') was used for the spandex feed. The knit fabric was not heat set.

Examples 11-27

Example 11

The 44-decitex spandex feed tension was 5 grams (4.9 cN), which is in the range of 4 to 6 cN recommended in the prior art.

Example 11A

The knit fabric of Example 11 was stretched and heat set at 190° C. for 60 seconds. The as-knit weight and elongation properties were the same as Example 11, but heat setting reduced the finished fabric to 204 g/m$^2$ and 115% elongation. The spandex content was the same as for Example 11.

Example 12

Spandex of 33 dtex T169B was knit with 20 Ne cotton hard yarn at a draft of 2.2×.

Example 13

Spandex of 33 dtex T169B was knit with 20 Ne cotton hard yarn at a draft of 1.8×.

Example 14

Spandex of 78 dtex T562B was knit with 26 Ne cotton hard yarn at a draft of 2.0×.

Example 15

Spandex of 78 dtex T562B was knit with 32 Ne cotton hard yarn at a draft of 1.8×. Content of this fabric was 19% spandex.

Example 16

Spandex of 78 dtex T562B was knit with 20 Ne cotton hard yarn at a draft of 1.7×.

Example 17

Spandex of 44 dtex T562B was knit with 20 Ne cotton hard yarn at a draft of 1.8×.

Example 18

Spandex of 22 dtex T162C was knit with 26 Ne cotton hard yarn at a draft of 2.1×. Content of this fabric was 4.0% spandex.

Example 19

Spandex of 22 dtex T162C was knit with 26 Ne cotton hard yarn at a draft of 2.5×. Content of this fabric was 4.0% spandex.

Example 20

Spandex of 78 dtex T162C was knit with 20 Ne cotton hard yarn at a draft of 2.0×. Content of this fabric was 6.0% spandex.

Example 21

Spandex of 22 dtex T162C was knit with 40 Ne spun polyester hard yarn at a draft of 1.9×.

Example 22

Spandex of 22 dtex T169B was knit with 156 decitex textured nylon hard yarn at a draft of 2.0×. This fabric was finished as a tube according to the processing path 61*b* in FIG. 5.

Example 23

Spandex of 22 dtex T169B was knit with 156 decitex textured nylon hard yarn at a draft of 2.0×. This fabric was finished open-width according to the processing path 61*a* in FIG. 5.

Example 24

Spandex of 22 dtex T562B was knit with 156 decitex textured nylon hard yarn at a draft of 2.0×. This fabric was finished as a tube according to the processing path 61*b* in FIG. 5.

Example 25

Spandex of 22 dtex T562B was knit with 156 decitex textured nylon hard yarn at a draft of 2.0×. This fabric was finished open-width according to the processing path 61*a* in FIG. 5.

Example 26

Spandex of 61 dtex T162C was knit with 116 decitex textured polypropylene hard yarn at a draft of 2.5×. Spandex content of this fabric was 18%. This fabric was finished open-width according to the processing path 61*a* in FIG. 5.

Example 27

Spandex of 61 dtex T162C was knit with 116 decitex textured polypropylene hard yarn at a draft of 2.0×. Spandex content of this fabric was 27%. This fabric was finished open-width according to the processing path 61*a* in FIG. 5.

Examples 28-32

Example 28

Spandex of 22 dtex T169B was knit with 32 Ne cotton hard yarn at a draft of 2.0×.

Example 29

Spandex of 22 dtex T162C was knit with 32 Ne cotton hard yarn at a draft of 2.0×.

Example 30

Spandex of 22 dtex T562B was knit with 32 Ne cotton hard yarn at a draft of 1.8×.

Example 31

Spandex of 22 dtex T562B was knit with 26 Ne cotton hard yarn at a draft of 2.0×.

Example 32

Spandex of 22 dtex T169B was knit with 32 Ne cotton hard yarn at a draft of 2.0×.

Examples 33-45

Example 33

The hard yarn in this example was textured polypropylene (50 denier, 55 decitex, 0.69 denier/filament). The spandex was Lycra® T165C (15 denier, 17 decitex) drafted at 2.0×. The fabric was dyed and finished according to 61*a*, FIG. 5.

Example 34

The hard yarn and spandex in this were the same as Example 37, but the spandex was drafted at 2.0×. The fabric was dyed and finished according to 61*a*, FIG. 5.

Example 35

The hard yarn in this example was textured polypropylene (50 denier, 55 decitex, 0.69 denier/filament). The spandex was Lycra® T169B (30 denier, 33 decitex) drafted at 2.0×. The Lycra® spandex content in the fabric of Example 35 was 25%. The fabric was dyed and finished according to 61*a*, FIG. 5.

Example 36

The hard yarn in this example was textured polypropylene (100 denier, 110 decitex, 1.39 denier/filament). The spandex was Lycra® T169B (30 denier, 33 decitex) drafted at 2.3×. The machine gauge for this example was 24 gg, machine (2) given in above spec. The fabric was dyed and finished according to 61*a*, FIG. 5.

Example 37

The hard yarn in this example was textured polypropylene (100 denier, 110 decitex, 2.08 denier/filament). The spandex was Lycra® T169B (30 denier, 33 decitex) drafted at 2.0×. The machine gauge for this example was 24 gg, machine (2) given in above spec. The fabric was dyed and finished according to 61*a*, FIG. 5.

Example 38

The hard yarn in this example was textured polypropylene (100 denier, 110 decitex, 2.08 denier/filament). The spandex was Lycra® T162B (40 denier, 44 decitex) drafted at 2.0×. The fabric was dyed and finished according to 61*a*, FIG. 5. Xrel, which is a measure of resistance to chlorine degradation, is superior to the state of the art comparison fabric, Table 3.

Example 39

The hard yarn in this example was textured polypropylene (150 denier, 165 decitex, 4.17 denier/filament). The spandex was Lycra® T162C (70 denier, 78 decitex) drafted at 2.5×. The machine gauge for this example was 24 gg, machine (2) given in above spec. The fabric was dyed and finished according to 61*a*, FIG. 5.

Example 40

In this example, two hard yarns were plated with a spandex elastic yarn using a yarn carrier as in FIG. 2, which has an additional hole at XX. The hard yarn in this example was a 50/50 blend of textured polypropylene (50 denier, 55 decitex, 0.69 denier/filament) and ring spun cotton (40/1 Ne, 130 denier, 143 decitex). The spandex was Lycra® T169B (20, denier, 22 decitex) drafted at 2.0×. The machine gauge for this example was 24 gg, machine (2) given in above spec. The fabric was dyed and finished according to 61*a*, FIG. 5.

Example 41

The hard yarn in this example was textured polypropylene (50 denier, 55 decitex, 0.7 denier/filament). The spandex was Lycra® T169B (30 denier, 33 decitex) drafted at 2.5×. The machine for this example was 28 gg machine (1) given in above spec. The fabric was finished according to 61*a*, FIG. 5.

Example 42

The hard yarn in this example was textured polypropylene (100 denier, 110 decitex, 1.4 denier/filament). The spandex was Lycra® T169B (30 denier, 33 decitex) drafted at 2.0×. The machine for this example was 24 gg machine (2) given in above spec. The fabric was finished according to 61*a*, FIG. 5.

Example 43

The hard yarn in this example was textured polypropylene (100 denier, 110 decitex, 1.4 denier/filament). The spandex was Lycra® T169B (30 denier, 33 decitex) drafted at 2.5×. The machine for this example was 24 gg machine (2) given in above spec. The fabric was finished according to 61*a*, FIG. 5.

Example 44

The hard yarn in this example was textured polypropylene (100 denier, 110 decitex, 1.4 denier/filament). The spandex was Lycra® T162B (40 denier, 44 decitex) drafted at 2.5×. The machine for this example was 24 gg machine (2) given in above spec. The fabric was finished according to 61*a*, FIG. 5.

Example 45

The hard yarn in this example was textured polypropylene (150 denier, 165 decitex, 4.2 denier/filament). The spandex was Lycra® T162C (70 denier, 78 decitex) drafted at 2.0×. The machine for this example was 24 gg machine (2) given in above spec. The fabric was finished according to 61*a*, FIG. 5.

Example 46

The hard yarn in this example was textured polypropylene (100 denier, 110 decitex, 1.4 denier/filament). The spandex was Lycra® T162B (40 denier, 44 decitex) drafted at 2.0×. The fabric was finished according to 61*b*, FIG. 5, but was not compacted.

Example 47

The hard yarn in this example was textured polypropylene (100 denier, 110 decitex, 1.4 denier/filament). The spandex was Lycra® T162B (40 denier, 44 decitex) drafted at 2.0×. The fabric was knit on a 24 gg Pai Lung Model PL-XS3B/C knitting machine and slit open into a flat fabric manually. The slit fabric was sewn back into a tube and scoured according to path 61*a* in FIG. 5. The fabric was de-tacked after scouring and dried in an open width form on a tenter frame at 130° C. for 45 seconds.

Example 48

The hard yarn in this example was a polyethylene terepthalate (PET) polymer, hereinafter referred to as a "2GT polyester"; The spandex was Lycra® T169B, 33 decitex, and drafted at 2.5×. The fabric was dyed and finished according to the process path 61*a* schematically shown in FIG. 5. The fabric was dyed to a blue shade.

Example 49

The hard yarn in this example was 2GT polyester. The spandex was Lycra® T169B, 33 decitex, and drafted at 2.5×. The fabric was dyed and finished according to the process path 61*a* schematically shown in FIG. 5. The fabric was dyed to a black shade.

Example 50

The hard yarn in this example was 2GT polyester. The spandex was Lycra® T169B, 33 decitex, and drafted at 2.5×. The fabric was dyed and finished according to the process path 61*a* schematically shown in FIG. 5. The fabric was dyed to a red shade.

Example 51

The hard yarn in this example was 2GT polyester. The spandex was Lycra® T169B, 33 decitex, and drafted at 2.5×. The fabric was dyed and finished according to the process path 61*a* schematically shown in FIG. 5. The fabric was dyed to a purple shade.

Example 52

The hard yarn in this example was 2GT polyester. The spandex was Lycra® T162C, 44 decitex, and drafted at 2.5×. The fabric was dyed and finished according to the process path 61*a* schematically shown in FIG. 5. The fabric was dyed to a blue shade.

Example 53

The hard yarn in this example was 2GT polyester. The spandex was Lycra® T162C, 44 decitex, and drafted at 2.5×. The fabric was dyed and finished according to the process path 61*a* schematically shown in FIG. 5. The fabric was dyed to a black shade.

Example 54

The hard yarn in this example was 2GT polyester. The spandex was Lycra® T162C, 44 decitex, and drafted at 2.5×. The fabric was dyed and finished according to the process path 61*a* schematically shown in FIG. 5. The fabric was dyed to a red shade.

Example 55

The hard yarn in this example was 2GT polyester. The spandex was Lycra® T162C, 44 decitex, and drafted at 2.5×. The fabric was dyed and finished according to the process path 61*a* schematically shown in FIG. 5. The fabric was dyed to a purple shade.

Examples 56-59

Example 56

A two end French terry fabric was knit in this example using 100% cotton 30/1 Ne yarn for the jersey feeds and 100% cotton 20/1 Ne yarns for the loops. Jersey feeds were plated with 33 dtex T562B Lycra® at a draft of 1.9×. Fabrics were wet processed and napped to give a single-sided fleece finished fabric according to path 81*b* of FIG. 6.

Example 57

A two end French terry fabric was knit in this example using 100% cotton 30/1 Ne yarn for the jersey feeds and 100% cotton 20/1 Ne yarns for the loops. Jersey feeds were plated with 33 dtex T562B Lycra® at a draft of 1.9×. Fabrics were wet processed and finished to give a French terry finished fabric according to path 81*b* of FIG. 6.

Example 58

A two end French terry fabric was knit in this example using 100% cotton 30/1 Ne yarn for the jersey feeds and 100% cotton 20/1 Ne yarns for the loops. Jersey feeds were plated with 22 dtex T562B Lycra® at a draft of 1.9×. Fabrics were wet processed and napped to give a single-sided fleece finished fabric according to path 81*b* of FIG. 6.

Example 59

A two end French terry fabric was knit in this example using 100% cotton 30/1 Ne yarn for the jersey feeds and 100% cotton 20/1 Ne yarns for the loops. Jersey feeds were plated with 22 dtex T562B Lycra® at a draft of 1.9×. Fabrics were wet processed and finished to give a French terry finished fabric according to path 81*b* of FIG. 6.

Thus it should be apparent that there has been provided in accordance with the present invention a circular knit,-elastic fabric having a bare elastomeric material plated with spun and/or continuous filament hard yarns, as well as methods of producing same that do not require a dry heat setting step, that fully satisfies the objectives and advantages set forth above. Although the invention has been described in conjunction with specific embodiments thereof, it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. A method for making a circular knit, elastic, single jersey fabric, the method comprising the steps of:

providing an elastomeric material;

providing at least one hard yarn selected from the group consisting of spun yarns, continuous filament yarns and combinations thereof;

plating the elastomeric material with the at least one hard yarn; and circular knitting the plated elastomeric material and at least one hard yarn in every knit course to form a circular knit, elastic, single jersey fabric, wherein feed of the elastomeric material is controlled so that the elastomeric material is drafted no more than about 2.5× its original length when knit to form the circular knit, elastic, single jersey fabric.

2. The method of claim 1 wherein, in the step of providing an elastomeric material, the elastomeric material is further defined as bare spandex yarn.

3. The method of claim 1 wherein, in the step of providing an elastomeric material, the elastomeric material is further defined as bare spandex yarn from about 15 to about 156 dtex.

4. The method of claim 1 wherein, in the step of providing at least one hard yarn, the at least one hard yarn is further defined as a hard yarn having a yarn count (Ne) from about 10 to about 85.

5. The method of claim 1 wherein, in the step of circular knitting the plated elastomeric material and at least one hard yarn in every knit course to form a circular knit, elastic, single jersey fabric, the circular knit, elastic, single jersey fabric has a cover factor of from about 1.05 to about 1.9.

6. The method of claim 1 further comprising the step of exposing the circular knit, elastic, single jersey fabric to at least one further treatment step, wherein such treatment step occurs at a temperature below a temperature required to heat set the elastomeric material.

7. The method of claim 6 wherein the circular knit, elastic, single jersey fabric is exposed to a temperature below about 160° C. during the at least one further treatment step.

8. The method of claim 6, wherein the at least one further treatment step is selected from the group consisting of cleaning, bleaching, dyeing, drying, compacting, and any combination thereof.

9. The method of claim 8, wherein the at least one further treatment step is selected from the group consisting of drying, compacting, and combinations thereof, and wherein the circular knit, elastic, single jersey fabric is subjected to an overfeed in its length during the at least one further treatment step.

10. The method of claim 1, wherein the circular knit, elastic, single jersey fabric has an elastomeric content of from about 3.5% to about 30% by weight based on the total fabric weight per square meter.

11. The method of claim 1 wherein, in the step of providing at least one hard yarn, the at least one hard yarn is selected from the group consisting of synthetic filament, spun staple yarn of natural fibers, natural fibers blended with synthetic fibers or yarns, spun staple yarn of cotton, cotton blended with synthetic fibers or yarns, spun staple polypropylene, polyethylene or polyester blended with polypropylene, polyethylene or polyester fibers or yarns, and combinations thereof.

12. The method of claim 1,wherein the at least one hard yarn is selected from the group consisting of cotton and a cotton blend, and the circular knit, elastic, single jersey fabric has a basis weight of from about 140 to about 500 g/m$^2$.

13. The method of claim 1, wherein the circular knit, elastic, single jersey fabric has an elongation of at least about 45% in a warp direction thereof.

14. The method of claim 1, wherein the circular knit, elastic, single jersey fabric has a shrinkage of about 15% or less after washing.

15. The method of claim 1, wherein the circular knit, elastic, single jersey fabric is produced in the form of a tube and has substantially no visible side creases formed therein.

16. The method of claim 1, wherein the circular knit, elastic, single jersey fabric has substantially higher resistance to degradation by chlorine than a like fabric that has been exposed to bare spandex heat setting temperature.

17. A circular knit, elastic, single jersey fabric made by the method comprising the steps of:

providing an elastomeric material;

providing at least one hard yarn selected from the group consisting of spun yarns, continuous filament yarns and combinations thereof;

plating the elastomeric material with the at least one hard yarn; and circular knitting the plated elastomeric material and at least one hard yarn in every knit course to form a circular knit, elastic, single jersey fabric, wherein feed of the elastomeric material is controlled so that the elastomeric material is drafted no more than about 2.5× its original length when knit to form the circular knit, elastic, single jersey fabric.

18. The circular knit, elastic, single jersey fabric of claim 17, wherein the elastomeric material is further defined as bare spandex yarn.

19. The circular knit, elastic, single jersey fabric of claim 17, wherein the at least one hard yarn is selected from the group consisting of cotton and a cotton blend, and the circular knit, elastic, single jersey fabric has a basis weight of from about 140 to about 500 g/m$^2$.

20. The circular knit, elastic, single jersey fabric of claim 17, wherein the circular knit, elastic, single jersey fabric has an elongation of at least about 45% in a warp direction thereof.

21. The circular knit, elastic, single jersey fabric of claim 17, wherein the circular knit, elastic, single jersey fabric has a shrinkage of about 15% or less after washing.

22. The circular knit, elastic, single jersey fabric of claim 17, wherein the circular knit, elastic, single jersey fabric is produced in the form of a tube and has substantially no visible side creases formed therein.

23. The circular knit, elastic, single jersey fabric of claim 17, wherein the circular knit, elastic, single jersey fabric has substantially higher resistance to degradation by chlorine than a like fabric that has been exposed to bare spandex heat setting temperature.

24. A garment made from the circular knit, elastic, single jersey fabric of claim 17.

25. The garment of claim 24, wherein the elastomeric material is further defined as bare spandex yarn.

26. The garment of claim 24, wherein the at least one hard yarn is selected from the group consisting of cotton and a cotton blend, and the circular knit, elastic, single jersey fabric has a basis weight of from about 140 to about 500 g/m$^2$.

27. The garment of claim 24, wherein the circular knit, elastic, single jersey fabric has an elongation of at least 45% in a warp direction thereof.

28. The garment of claim 24, wherein the circular knit, elastic, single jersey fabric has a shrinkage of about 15% or less after washing.

29. The garment of claim 24, wherein the circular knit, elastic, single jersey fabric has substantially higher resistance to degradation by chlorine than a like fabric that has been exposed to bare spandex heat setting temperature.

30. A circular knit, elastic, single jersey fabric comprising:

a bare spandex yarn, wherein the bare spandex yarn is from about 15 to about 156 dtex and can be heat set within a heat setting efficiency of at least about 85% at a heat setting temperature at least one hard yarn, wherein the at least one hard yarn has a yarn count (Ne) of about 10 to about 85; wherein the plated bare spandex yarn and at east one hard yarn in every knit course form a circular knit, elastic fabric having a cover factor of from about 105 to about 1.9;

the bare spandex yarn in the circular knit, elastic, single jersey fabric is drafted no more than about 2.5× its original length; and the circular knit, elastic, single jersey fabric has not been exposed to the heat setting temperature of the bare spandex yarn during processing.

31. The fabric of claim 30, wherein the bare spandex yarn is present in the circular knit, elastic, single jersey fabric in an amount from about 3.5% to about 30% by weight based on the total fabric weight per square meter.

32. The fabric of claim 30, wherein the circular knit, elastic, single jersey fabric has a cover factor of about 1.4.

33. The fabric of claim 30 wherein the fabric has been treated with at least one step selected from the group consisting of drying, compacting, and combinations thereof, and wherein the circular knit, elastic, single jersey fabric has been subjected to an overfeed in its length during the at least one treatment step.

34. The fabric of claim 30, wherein the fabric has been treated with at least one further treatment step, wherein such treatment step occurs at a temperature below about 160°C.

35. The fabric of claim 34, wherein the at least one further treatment step is selected from the group consisting of cleaning, bleaching, dyeing, drying, compacting, and any combination thereof.

36. The fabric of claim 30, wherein the circular knit, elastic, single jersey fabric is produced in the form of a tube and has substantially no visible side creases formed therein.

37. The fabric of claim 30, wherein the circular knit, elastic, single jersey fabric has higher resistance to degradation by chlorine than a like fabric that has been exposed to bare spandex heat setting temperature.

38. The circular knit, elastic, single jersey fabric of claim 37, wherein the hard yarn is cotton or a cotton blend, and the circular knit, elastic, single jersey fabric has a basis weight of from about 140 to about 500 g/m$^2$.

39. The circular knit, elastic, single jersey fabric of claim 37, wherein the circular knit, elastic, single jersey fabric has an elongation of at least about 45% in a warp direction thereof.

40. The circular knit, elastic, single jersey fabric of claim 37, wherein the circular knit, elastic, single jersey fabric has a shrinkage of about 15% or less after washing.

41. The circular knit, elastic, single jersey fabric of claim 37, wherein the circular knit, elastic, single jersey fabric is produced in the form of a tube and has substantially no visible side creases formed therein.

42. The circular knit, elastic, single jersey fabric of claim 37, wherein the circular knit, elastic, single jersey fabric has substantially higher resistance to degradation by chlorine than a like fabric that has been exposed to bare spandex heat setting temperature.

43. A garment made from the circular knit, elastic, single jersey fabric of claim 30.

44. The garment of claim 43, wherein the hard yarn is cotton or a cotton blend, and the circular knit, elastic, single jersey fabric has a basis weight of from about 140 to about 500 g/m$^2$.

45. The garment of claim 43, wherein the circular knit, elastic, single jersey fabric has an elongation of at least about 45% in a warp direction thereof.

46. The garment of claim 43, wherein the circular knit, elastic, single jersey fabric has a shrinkage of about 15% or less after washing.

47. The garment of claim 43, wherein the circular knit, elastic, single jersey fabric has substantially high resistance to degradation by chlorine.

48. A method for making a circular knit, elastic fabric of at least one of French terry and fleece, the method comprising the steps of:

providing an elastomeric material;

providing at least two hard yarns selected from the group consisting of spun yarns, continuous filament yarns and combinations thereof;

plating the elastomeric material with the at least two hard yarns; and circular knitting the plated elastomeric material and at least two hard yarns to form a circular knit, elastic fabric of at least one of French terry and fleece, wherein the elastomeric material is knit in every other course, and wherein feed of the elastomeric material is controlled so that the elastomeric material is drafted no more than about 2.5× its original length when knit to form the circular knit, elastic fabric of at least one of French terry and fleece.

49. The method of claim 48 wherein, in the step of providing an elastomeric material, the elastomeric material is further defined as bare spandex yarn.

50. The method of claim 48 wherein, in the step of providing an elastomeric material, the elastomeric material is further defined as bare spandex yarn from about 15 to about 156 dtex.

51. The method of claim 48 wherein, in the step of providing at least two hard yarns, each of the at least two hard yarns is further defined as a hard yarn having a yarn count (Ne) from about 10 to about 85.

52. The method of claim 48 wherein, in the step of circular knitting the plated elastomeric material and at least two hard yarns, the circular knit, elastic fabric of at least one of French terry and fleece has a cover factor of from about 1.05 to about 1.9.

53. The method of claim 48 further comprising the step of exposing the circular knit, elastic fabric of at least one of French terry and fleece to at least one further treatment step, wherein such treatment step occurs at a temperature below a temperature required to heat set the elastomeric material.

54. The method of claim 53 wherein the circular knit, elastic fabric of at least one of French terry and fleece is exposed to a temperature below about 160° C. during the at least one further treatment step.

55. The method of claim 53, wherein the at least one further treatment step is selected from the group consisting of cleaning, bleaching, dyeing, drying, napping, brushing, compacting, and any combination thereof.

56. The method of claim 55, wherein the at least one further treatment step is selected from the group consisting of drying, compacting, and combinations thereof, and wherein the circular knit, elastic fabric of at least one of French terry and fleece is subjected to an overfeed in its length during the at least one further treatment step.

57. The method of claim 48, wherein the circular knit, elastic fabric of at least one of French terry and fleece has an elastomeric content of from about 3.5% to about 30% by weight based on the total fabric weight per square meter.

58. The method of claim 48 wherein, in the step of providing at least two hard yarns, each of the at least two hard yarns is selected from the group consisting of synthetic filament, spun staple yarn of natural fibers, natural fibers blended with synthetic fibers or yarns, spun staple yarn of cotton, cotton blended with synthetic fibers or yarns, spun staple polypropylene, polyethylene or polyester blended with polypropylene, polyethylene or polyester fibers or yarns, and combinations thereof.

59. The method of claim 48, wherein at least one of the at least two hard yarns is selected from the group consisting of cotton and a cotton blend, and the circular knit, elastic fabric of at least one of French terry and fleece has a basis weight of from about 140 to about 500 g/m$^2$.

60. The method of claim 48 wherein, in the step of providing at least two hard yarns, the at least two hard yarns are the same.

61. The method of claim 48 wherein, in the step of providing at least two hard yarns, the at least two hard yarns are different.

62. The method of claim 48, wherein the circular knit, elastic fabric of at least one of French terry and fleece has an elongation of at least about 45% in a warp direction thereof.

63. The method of claim 48, wherein the circular knit, elastic fabric of at least one of French terry and fleece has a shrinkage of about 15% or less after washing.

64. The method of claim 48, wherein the circular knit, elastic fabric of at least one of French terry and fleece has substantially high resistance to degradation by chlorine.

65. A circular knit, elastic fabric, of at least one of French terry and fleece made by the method comprising the steps of:

providing an elastomeric material;

providing at least two hard yarns selected from the group consisting of spun yarns, continuous filament yarns and combinations thereof;

plating the elastomeric material with the at least two hard yarns; and circular knitting the plated elastomeric material and at least two hard yarns to form a circular knit, elastic fabric of at least one of French terry and fleece, wherein the elastomeric material is knit in every other course, and wherein feed of the elastomeric material is controlled so that the elastomeric material is drafted no more than about 2.5× its original length when knit to form the circular knit, elastic fabric of at least one of French terry and fleece.

66. The circular knit, elastic fabric of at least one of French terry and fleece of claim 65, wherein the elastomeric material is further defined as bare spandex yarn.

67. The circular knit, elastic fabric of at least one of French terry and fleece of claim 65, wherein at least one of the at least two hard yarns is selected from the group consisting of cotton and a cotton blend, and the circular knit, elastic fabric of at least one of French terry and fleece has a basis weight of from about 140 to about 500 g/m$^2$.

68. The circular knit, elastic fabric of at least one of French terry and fleece of claim 65, wherein the circular knit, elastic fabric of at least one of French terry and fleece has an elongation of at least about 45% in a warp direction thereof.

69. The circular knit, elastic fabric of at least one of French terry and fleece of claim 65, wherein the circular knit, elastic fabric of at least one of French terry and fleece has a shrinkage of about 15% or less after washing.

70. The circular knit, elastic fabric of at least one of French terry and fleece of claim 65, wherein the circular knit, elastic fabric of at least one of French terry and fleece has substantially higher resistance to degradation by chlorine than a like fabric that has been exposed to bare spandex heat setting temperature.

71. The circular knit, elastic fabric of at least one of French terry and fleece of claim 65, wherein the at least two hard yarns are the same.

72. The circular knit, elastic fabric of at least one of French terry and fleece of claim 65, wherein the at least two hard yarns are different.

73. A garment made from the circular knit, elastic fabric of at least one of French terry and fleece of claim 65.

74. The garment of claim 73, wherein the elastomeric material is further defined as bare spandex yarn.

75. The garment of claim 73, wherein at least one of the at least two hard yarns is selected from the group consisting of cotton and a cotton blend, and the circular knit, elastic fabric of at least one of French terry and fleece has a basis weight of from about 140 to about 500 g/m$^2$.

76. The garment of claim 73, wherein the circular knit, elastic fabric of at least one of French terry and fleece has an elongation of at least about 45% in a warp direction thereof.

77. The garment of claim 73, wherein the circular knit, elastic fabric of at least one of French terry and fleece has a shrinkage of about 15% or less after washing.

78. The garment of claim 73, wherein the circular knit, elastic fabric of at least one of French terry and fleece has substantially higher resistance to degradation by chlorine than a like fabric that has been exposed to bare spandex heat setting temperature.

79. The garment of claim 73, wherein the at least two hard yarns are the same.

80. The garment of claim 73, wherein the at least two hard yarns are different.

81. A circular knit, elastic fabric of at least one of French terry and fleece comprising:

a bare spandex yarn wherein the bare spandex yarn is from about 15 to about 156 dtex and can be heat set within a heat setting efficiency of at least about 85% at a heat setting temperature;

at least two hard yarns wherein each of the at least two hard yarns has a yarn count (Ne) of about 10 to about 85; wherein the plated bare spandex yarn and at least two hard yarns form a circular knit, elastic fabric of at least one of French terry and fleece, wherein the bare spandex yarn is knit in every other course, and wherein the circular knit, elastic fabric of at least one of French terry and fleece has a cover factor of from about 1.05 to about 1.9;

the bare spandex yarn in the circular knit, elastic fabric of at least one of French terry and fleece is drafted no more than about 2.533 its original length; and the circular knit, elastic fabric of at least one of French terry and fleece has not been exposed to the heat setting temperature of the bare spandex yarn during processing.

82. The fabric of claim 81, wherein the bare spandex yarn is present in the circular knit, elastic fabric of at least one of French terry and fleece in an amount from about 3.5% to about 30% by weight based on the total fabric weight per square meter.

83. The fabric of claim 81, wherein the circular knit, elastic fabric of at least one of French terry and fleece has a cover factor of about 1.4.

84. The fabric of claim 81 treated by at least one further treatment step selected from the group consisting of drying, compacting, and combinations thereof, and wherein the circular knit, elastic fabric of at least one of French terry and fleece has been subjected to an overfeed in its length during at least one further treatment step.

85. The fabric of claim 81 that has been exposed to at least one further treatment step at a temperature below about 160° C.

86. The fabric of claim 85, wherein the at least one further treatment step is selected from the group consisting of cleaning, bleaching, dyeing, drying, napping, brushing, compacting, and any combination thereof.

87. The fabric of claim 81, wherein the circular knit, elastic fabric of at least one of French terry and fleece has substantially higher resistance to degradation by chlorine than a like fabric that has been exposed to bare spandex heat setting temperature.

88. The fabric of claim 81, wherein the at least two hard yarns are the same.

89. The fabric of claim 81, wherein the at least two hard yarns are different.

90. The circular knit, elastic fabric of at least one of French terry and fleece of claim 81, wherein at least one of the at least two hard yarns is cotton or a cotton blend, and the circular knit, elastic fabric of at least one of French terry and fleece has a basis weight of from about 140 to about 500 g/m$^2$.

91. The circular knit, elastic fabric of at least one of French terry and fleece of claim 81, wherein the circular knit, elastic fabric of at least one of French terry and fleece has an elongation of at least about 45% in a warp direction thereof.

92. The circular knit, elastic fabric of at least one of French terry and fleece of claim 81, wherein the circular knit, elastic fabric of at least one of French terry and fleece has a shrinkage of about 15% or less after washing.

93. The circular knit, elastic fabric of at least one of French terry and fleece of claim 81, wherein the circular knit, elastic fabric of at least one of French terry and fleece has substantially higher resistance to degradation by chlorine than a like fabric that has been exposed to bare spandex heat setting temperature.

94. The circular knit, elastic fabric of at least one of French terry and fleece of claim 81, wherein the at least two hard yarns are the same.

95. The circular knit, elastic fabric of at least one of French terry and fleece of claim 81, wherein the at least two hard yarns are different.

96. A garment made from the circular knit, elastic fabric of at least one of French terry and fleece of claim 81.

97. The garment of claim 96, wherein at least one of the at least two hard yarns is cotton or a cotton blend, and the circular knit, elastic fabric of at least one of French terry and fleece has a basis weight of from about 140 to about 500 g/m$^2$.

98. the garment of claim 96, wherein the circular knit, elastic fabric of at least one of French terry and fleece has an elongation of at least about 45% in a warp direction thereof.

99. The garment of claim 96, wherein the circular knit, elastic fabric of at least one of French terry and fleece has a shrinkage of about 15% or less after washing.

100. The garment of claim 96, wherein the circular knit, elastic fabric of at least one of French terry and fleece has substantially higher resistance to degradation by chlorine than a like fabric that has been exposed to bare spandex heat setting temperature.

101. The garment of claim 96, wherein the at least two hard yarns are the same.

102. The garment of claim 96, wherein the at least two hard yarns are different.

* * * * *